US007857384B2

(12) United States Patent
Miller

(10) Patent No.: US 7,857,384 B2
(45) Date of Patent: Dec. 28, 2010

(54) SEMI-CUSTOM FIT SLIPCOVER

(75) Inventor: Brenda Kay Miller, Jersey Shore, PA (US)

(73) Assignee: Sure Fit Inc., Allentown, PA (US)

( * ) Notice: Subject to any disclaimer, the term of this patent is extended or adjusted under 35 U.S.C. 154(b) by 0 days.

(21) Appl. No.: 12/142,464

(22) Filed: Jun. 19, 2008

(65) Prior Publication Data

US 2008/0252119 A1 Oct. 16, 2008

Related U.S. Application Data

(63) Continuation of application No. 11/245,791, filed on Oct. 6, 2005, now Pat. No. 7,472,954.

(60) Provisional application No. 60/616,556, filed on Oct. 6, 2004.

(51) Int. Cl.
*A47C 31/02* (2006.01)

(52) U.S. Cl. ..... 297/224; 297/225; 297/228

(58) Field of Classification Search ..... 297/224, 297/225, 228

See application file for complete search history.

(56) References Cited

U.S. PATENT DOCUMENTS

| | | | | | |
|---|---|---|---|---|---|
| 1,825,909 | A | * | 10/1931 | Levi | 297/224 |
| 2,123,667 | A | * | 7/1938 | Trubitz | 297/224 X |
| 2,183,828 | A | * | 12/1939 | Trubitz | 297/224 X |
| 2,416,806 | A | | 3/1947 | Waranch | |
| 2,793,683 | A | * | 5/1957 | Trubitt | 297/224 |
| 2,820,510 | A | * | 1/1958 | Sugarman | 297/225 X |
| 2,921,625 | A | | 1/1960 | Krasnov et al. | |
| 5,549,355 | A | * | 8/1996 | Illulian | 297/224 |
| 5,733,002 | A | * | 3/1998 | Riley et al. | 297/224 |
| 6,398,301 | B1 | | 6/2002 | Illulian | |
| 2004/0017101 | A1 | | 1/2004 | Illulian | |
| 2004/0155497 | A1 | | 8/2004 | Riley et al. | |
| 2006/0250003 | A1 | | 11/2006 | Baines et al. | |

FOREIGN PATENT DOCUMENTS

| | | | | | |
|---|---|---|---|---|---|
| FR | 2685860 | A1 | * | 7/1993 | 297/224 X |

* cited by examiner

*Primary Examiner*—Anthony D Barfield
(74) *Attorney, Agent, or Firm*—Foley & Lardner LLP

(57) ABSTRACT

A slipcover for a piece of furniture including a base, a back, first and second arms, and a seat portion. The slipcover has back pleats located at the respective back corners and having pleated seams and elastic, which runs through the pleated seams and travels across the back pleats for allowing the slipcover to expand over the largest perimeter of the furniture and then relax to fit the base of the furniture as the slipcover is placed on the furniture. First and second arm fronts cover respective top front portions of the first and second arms. A wrap skirt covers respective bottom portions of the first and second arms.

21 Claims, 16 Drawing Sheets

FIG. 4
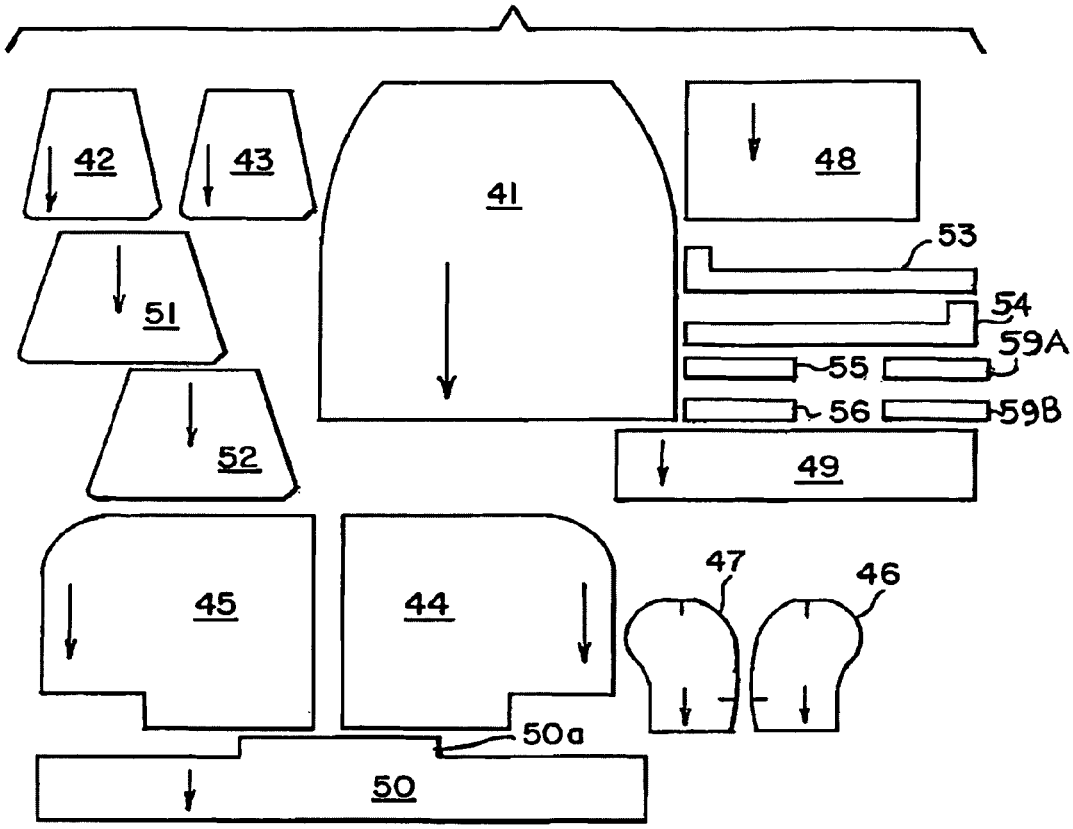
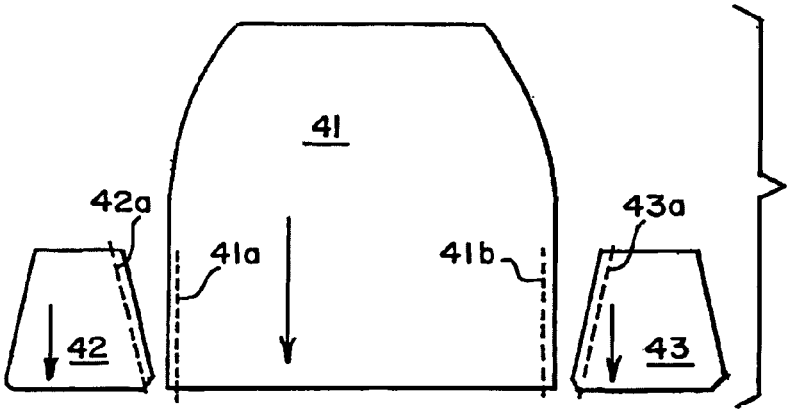
FIG. 5A

FIG. 5B
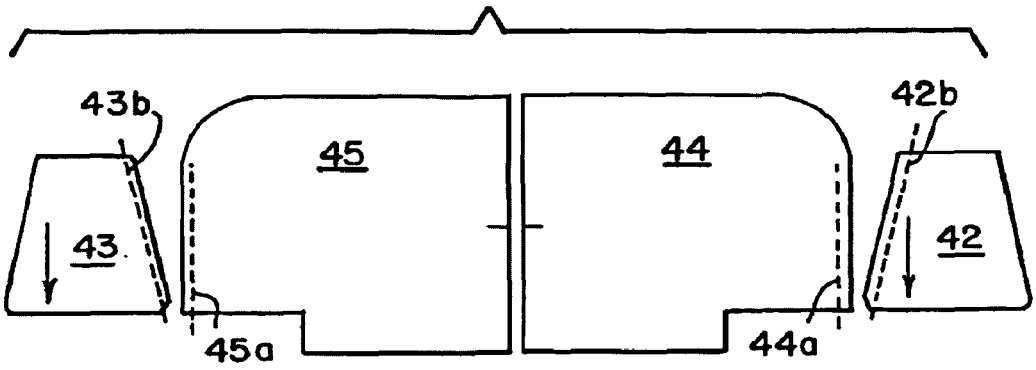
FIG. 5C
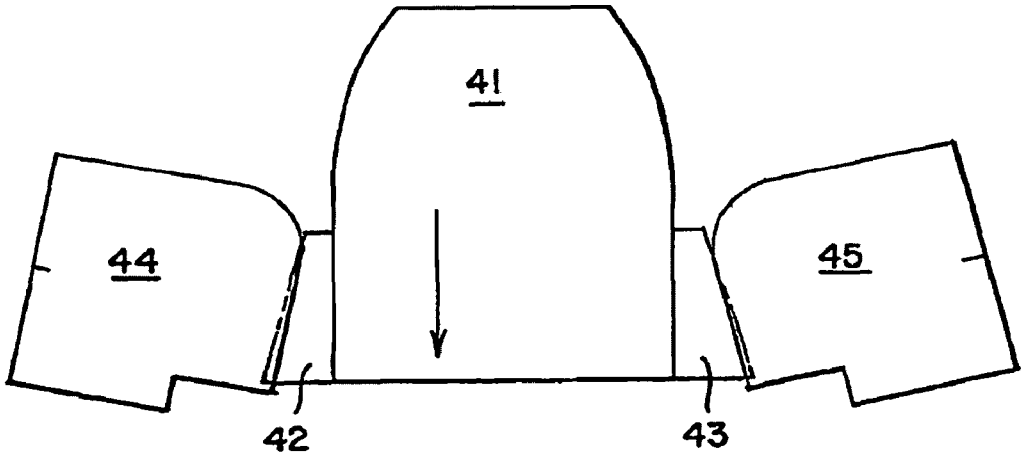
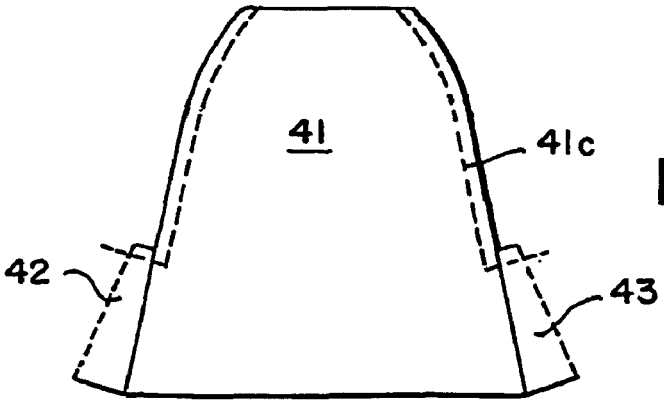
FIG. 5D

FIG. 7
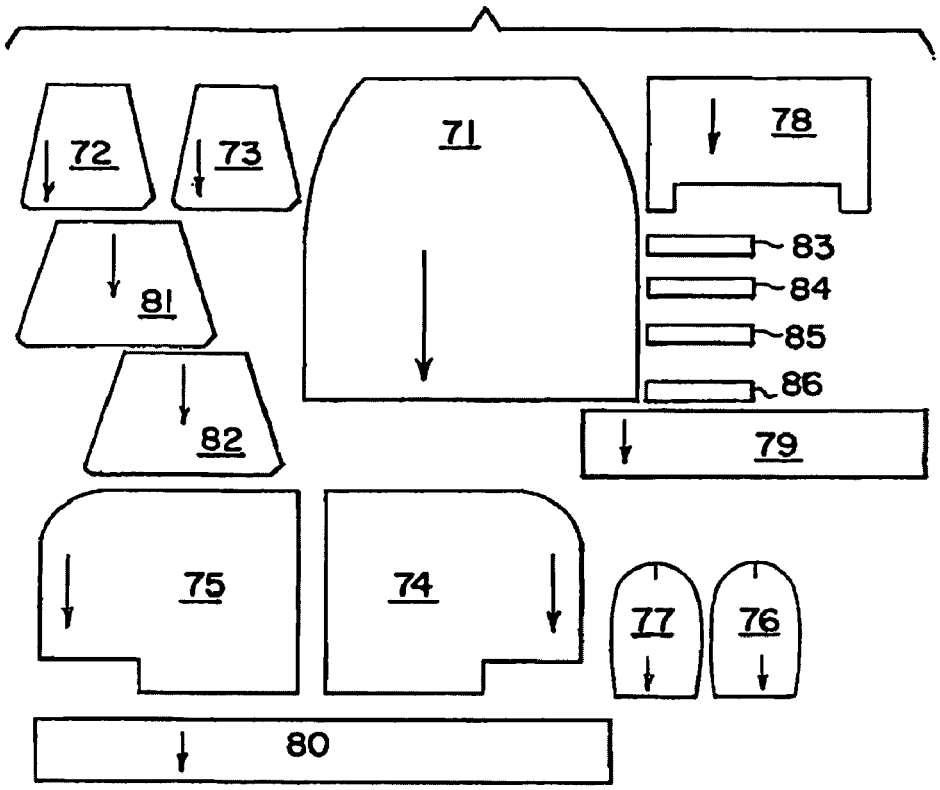
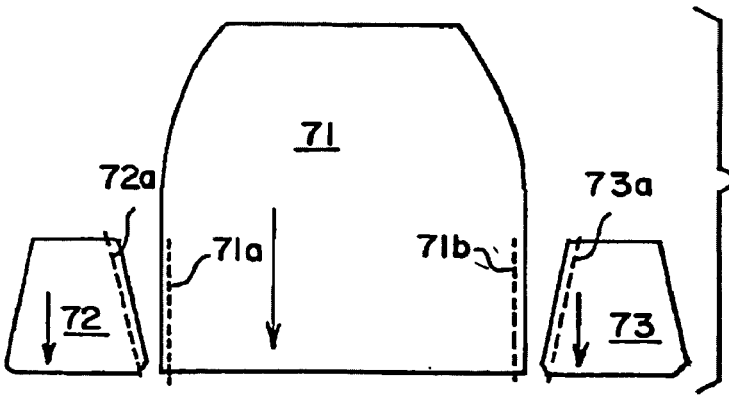
FIG. 8A

FIG. 8B
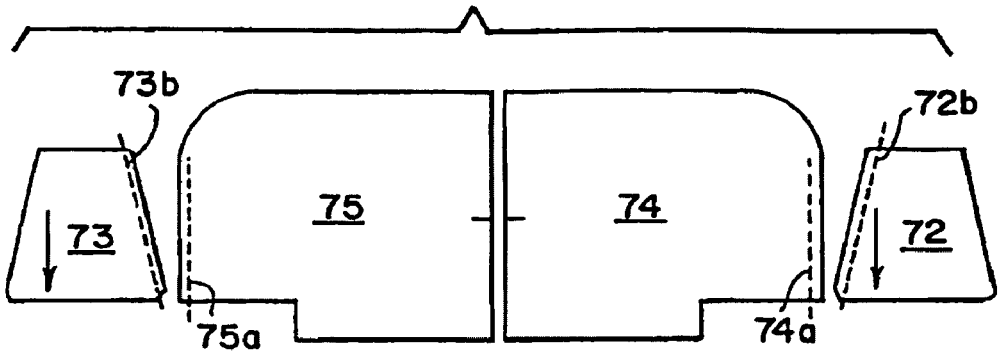
FIG. 8C
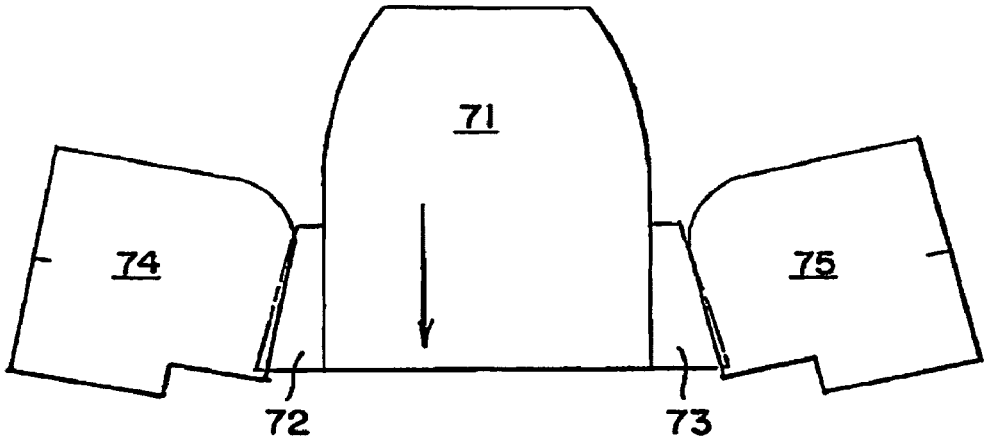
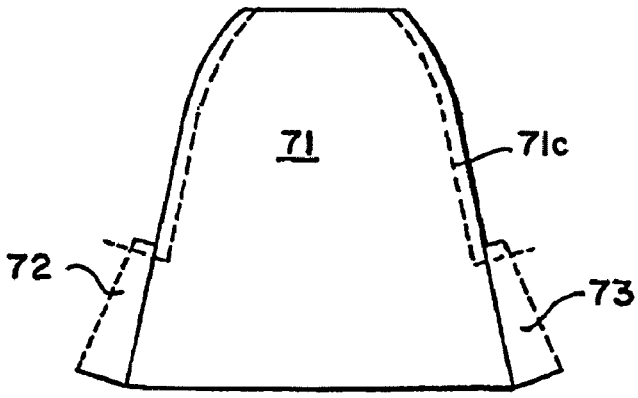
FIG. 8D

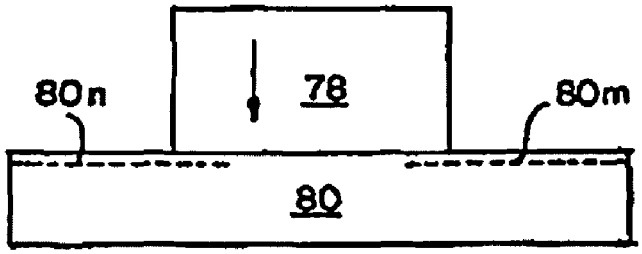
FIG. 8O
FIG. 8P
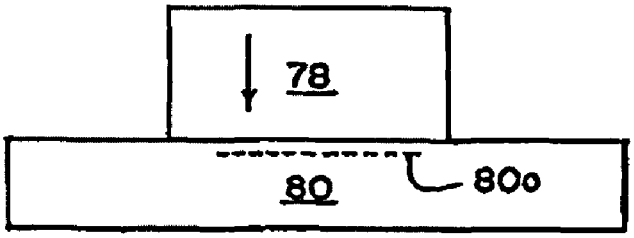
FIG. 8Q
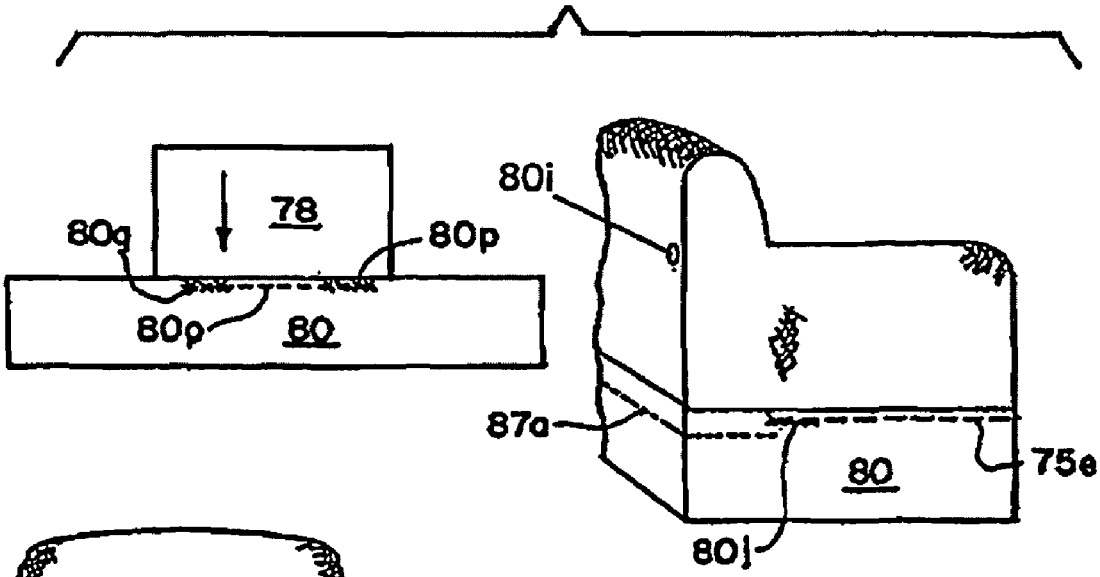
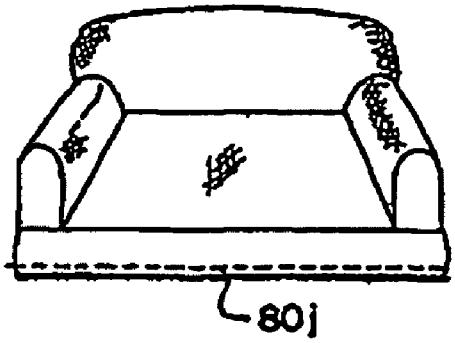
FIG. 8R

SEMI-CUSTOM FIT SLIPCOVER

CROSS REFERENCE TO RELATED APPLICATION

This application is a continuation application of U.S. patent application Ser. No. 11/245,791, filed on Oct. 6, 2005, which claims priority under 35 U.S.C. §119(e) from U.S. Patent Application Ser. No. 60/616,556, filed on Oct. 6, 2004, the disclosure for each of which is hereby incorporated by reference herein in its entirety.

FIELD OF THE INVENTION

The present invention relates to a slipcover for a piece of seating-type furniture, such as a chair, loveseat or sofa, and in particular to a slipcover that adjusts to semi-fit furniture of varying sizes.

BACKGROUND OF THE INVENTION

Slipcovers are widely used by consumers as an inexpensive alternative to re-upholstering a piece of seating-type furniture. Originally, slipcovers were custom tailored by a professional having the proper tools and training to precisely fit a particular piece of furniture. Custom tailored slipcovers, however, are typically as expensive as the cost of re-upholstering the piece of furniture.

Prefabricated slipcovers that can fit a variety of furniture items of typical dimensions and which can be more readily applied by the consumer have been designed. Though these slipcovers tend to be less expensive to produce than custom-tailored ones, they can be difficult to design to accommodate various styles and shapes of furniture, and often result in an unsatisfactory appearance due to improper fit.

BRIEF SUMMARY OF THE INVENTION

It is an object of the invention to provide a slipcover that accommodates various styles and shapes of furniture and yet still provides a good fit.

The slipcover of the present invention can accommodate different furniture sizes via pleated areas having elastic running therethrough. The slipcover is easily applied to a piece of furniture by expanding over the largest perimeter of the furniture and then relaxing to fit the smaller base of the furniture. The ability to expand over the largest perimeter of the furniture is through a pleated area at the two back corners of the slipcover. The ability to relax to fit the smaller base is achieved by the existence of elastic sewn next to or near the pleated seams and traveling across the pleated area.

The slipcover also accommodates different arm heights of the furniture using a split arm with modified wrap skirt function. More specifically, the arm pattern is separated into two pieces, one being the top of the arm and the other being a modified wrap skirt that covers a bottom portion of the arm.

BRIEF DESCRIPTION OF THE DRAWINGS

The foregoing and other features of the present invention will be more readily apparent from the following detailed description and drawings of illustrative embodiments of the invention, wherein like reference numerals delineate similar elements throughout the several views. In the drawings:

FIG. 4 is a plan view of the pattern components of the slipcover of FIGS. 3A-3E;

FIG. 7 is a plan view of the pattern components of the slipcover of FIGS. 6A-6E.

DETAILED DESCRIPTION OF CERTAIN EMBODIMENTS OF THE INVENTION

Figure 1:
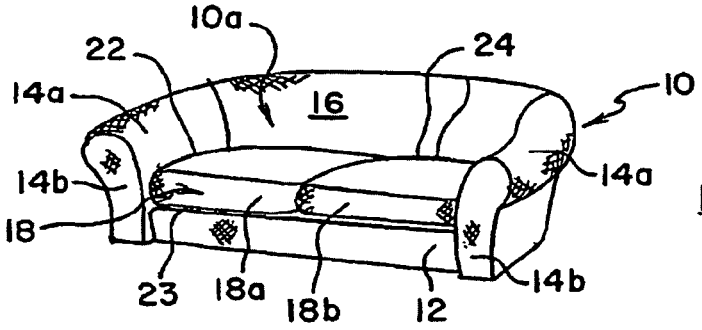
FIG. 1 PRIOR ART
FIG. 1 is a perspective view of a front side of a conventional item of seating-type furniture, in the form of a sofa.
Figure 2:
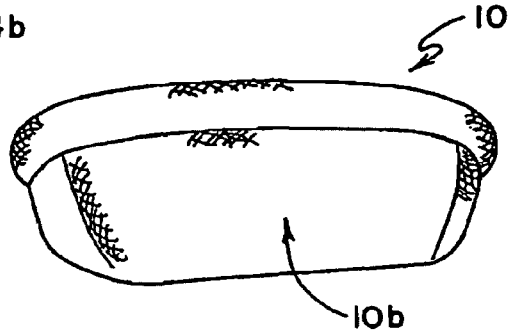
FIG. 2 PRIOR ART
FIG. 2 is a view of the rear side of the item of seating-type furniture illustrated in FIG. 1.

FIGS. 1 and 2 illustrate a typical item of seating-type furniture 10, which for purposes of this example, is a seat in the form of a sofa. It will be noted, however, that slipcovers according to the present invention may be used in combination with any of a variety of types of seating-type furniture having a base, a back, and at least one seat cushion, e.g., club chairs, sofabeds, and the like, though a seat cushion is not necessarily required. FIG. 1 illustrates the front side 10*a* (i.e., the seated side) of the sofa 10, while FIG. 2 illustrates the rear side 10*b* of the sofa. The sofa includes a seat base 12, which is typically somewhat rigid so that it can support the rest of the furniture body and things which may be positioned thereon, such as a person (not shown). The base 12 can be of a variety of shapes, and may include supplemental legs (not shown) or the like.

The sofa 10 preferably includes first and second arms 14 (which include arm sides 14*a* and arm fronts 14*b*), which extend upwardly from opposite ends of the base 12, and are connected to each other by way of a sofa back 16. The back 16 is illustrated as being relatively smooth and continuous, though it is noted that any of a variety of shaped sofas could also be used in combination with a slipcover according to the present invention. For example, the back 16 of the sofa 10 to be covered can be of the conventional camel back shape, or the like.

A cushioned region 18 extends substantially horizontally across the sofa base 12, to provide a sitting surface for a user of the sofa 10. In the illustrated embodiment, the cushioned region 18 includes first and second individual seat cushions 18*a*, 18*b*. It is noted, however, that items of furniture usable in combination with slipcovers of the present invention can include a single bench-style cushion or a plurality of cushions.

The cushioned region 18 (i.e., individual cushions 18*a*, 18*b*) is preferably at least partially separable from the seat base 12, such that a crevice 23 is located between a lower front edge of the cushioned region and the seat base. A crevice 22 is also preferably located between the cushioned region 18 and each of the sofa arms 14, and a crevice 24 is desirably located between the cushioned region and the sofa back 16.

As explained in further detail below, the slipcover of the present invention may be easily applied to a piece of furniture by expanding over the largest perimeter of the furniture and then relaxing to fit the smaller base of the furniture. The ability to expand over the largest perimeter of the furniture is through a pleated area at the two back corners of the slipcover. The ability to relax to fit the smaller base is achieved by the existence of elastic sewn next to or near the pleat seams and traveling across the pleated area. The slipcover also accommodates various arm heights through a split arm with modified wrap skirt function. More specifically, the arm pattern is separated into two pieces, one being the top of the arm and the other being a modified wrap skirt that covers a bottom portion of the arm.

A slipcover according to a first embodiment of the present invention is shown generally at 30 in FIGS. 3A-3E, 4, and 5A-5S, with FIGS. 3A-3E illustrating the slipcover 30 being applied to the sofa 10 depicted in FIGS. 1 and 2, FIG. 4 illustrating pattern components of the slipcover 30 of FIGS. 3A-3E, and FIGS. 5A-5S illustrating a sewing sequence for assembling the pattern components of FIG. 4 to manufacture the slipcover 30 of FIGS. 3A-3E.

The slipcover 30 of this first embodiment does not include covers for seat cushions. However, it is understood that seat cushion covers, which do not form a part of this invention, can be manufactured and applied in any known manner.

Figure 3A:
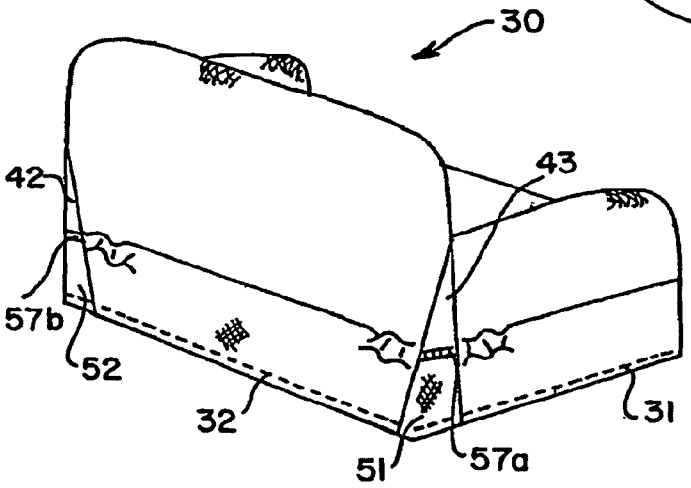
FIGS. 3A-3E are perspective views of a slipcover according to a first embodiment of the present invention being applied to the seating-type furniture illustrated in FIG. 1.

FIGS. 3A-3E illustrate the slipcover 30 being applied to the sofa 10 illustrated in FIGS. 1 and 2. As shown in FIG. 3A, the slipcover 30 is first placed over the back of the sofa 10, and back pleats 42, 43, 51, 52 open to accommodate the sofa circumference. The back and sides of the slipcover 30 are then placed evenly with the floor. Hems are represented by the dotted lines 31, 32, which run parallel with the surface of the floor.

Figure 3B:
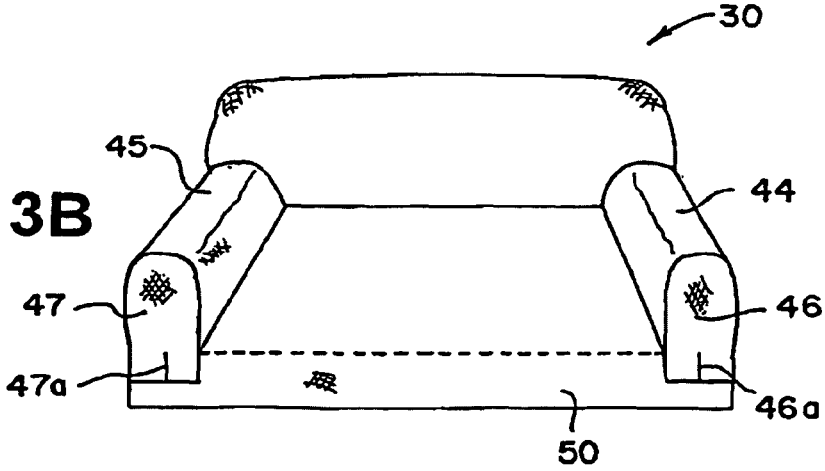
Figure 3C:
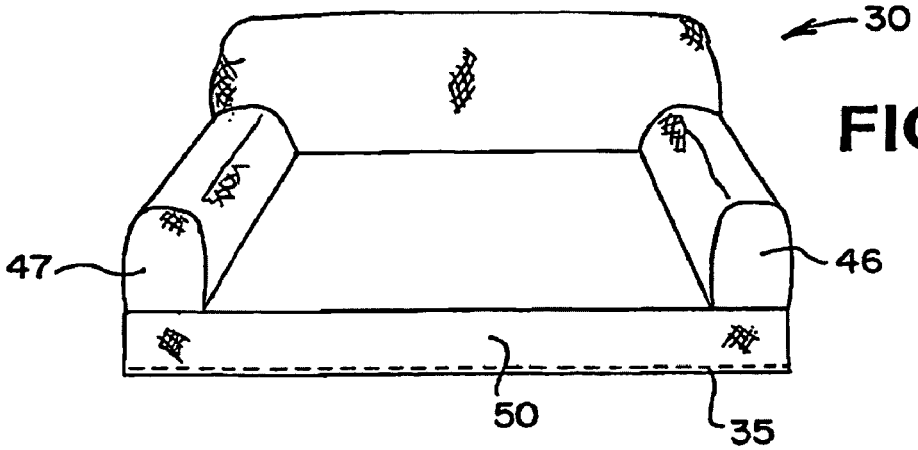

As shown in FIG. 3B, the slipcover 30 is then pulled over the front of the sofa. The arms 44, 45, 46, 47 of the cover 30 are set onto the sofa arms 14 and pulled over the arm 14. The dart lines 46*a*, 47*a* are formed from darting the left and right arm fronts 46, 47, as explained in detail further below. As shown in FIG. 3C, the front ruffle 50 is then adjusted over the base of the sofa arms 14 such that it covers the dart lines 46*a*, 47*a*, and the front, bottom edge of the slipcover 30 is placed to be even with the surface of the floor. Dotted line 35, which runs parallel with the surface of the floor, represents a hem line.

Figure 3D:
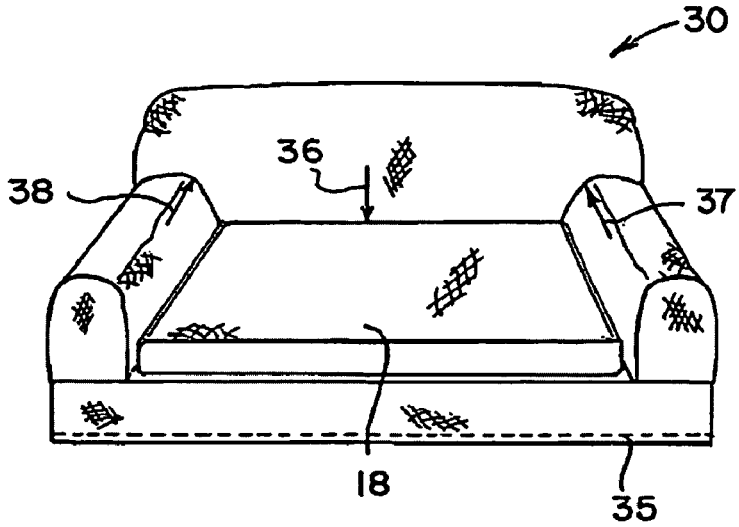

FIG. 3D shows a single seat cushion 18, which is covered with a cushion cover, set onto the base 12 of the sofa 10. Alternatively, there could be multiple seat cushions in place of the single seat cushion. The covering for the seat cushion(s) does not form a part of the present invention, and thus its description is omitted here. The slipcover 30 is then tucked into intersections between the sofa back 16 and the arms 14, as indicated by arrows 37 and 38, and is tucked into intersection between the sofa back 16 and the seat cushion 18, as indicated by arrow 36.

Figure 3E:
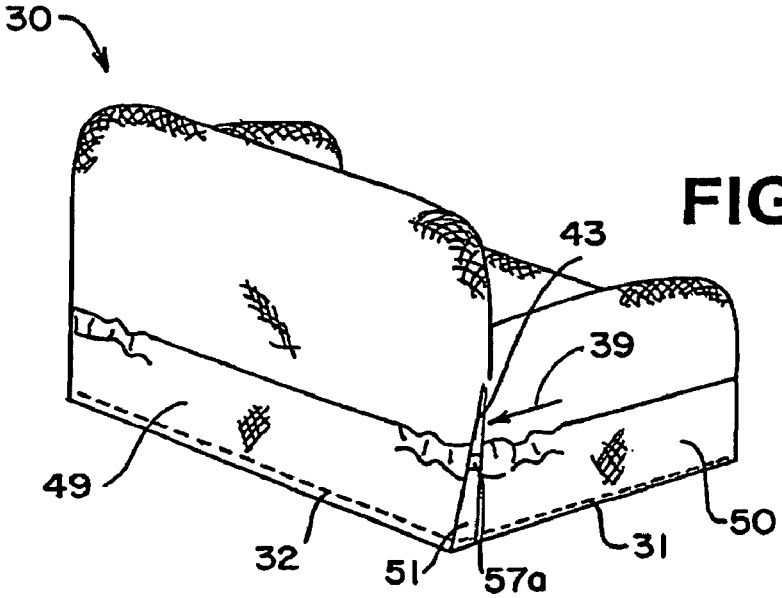

Finally, as shown in FIG. 3E, the pleats are closed at the sofa base by pulling on ends of the front ruffle 50 and back ruffle 49 bordering the pleated area, as indicated by the arrow 39. The slipcover easily relaxes to fit the smaller base through the elastic 57*a* (and 57*b*, which is not shown) sewn into the pleated seams and traveling across the pleated areas.

FIG. 4 is a plan view of the pattern components of the slipcover 30 of the first embodiment of the present invention, where the arrows denote grain lines of the fabric. FIGS. 5A-5S are plan views illustrating a sewing sequence for assembling the pattern components of FIG. 4 to manufacture the slipcover of FIGS. 3A-3E.

Referring to FIG. 4, the pattern components include a back 41, two top pleats 42, 43, left arm side 44, right arm side 45, left arm front 46, right arm front 47, seat 48, back ruffle 49, front ruffle 50, two bottom pleats 51, 52, two front facings 53, 54, and two back facings 55, 56, and two side facings 59A, 59B. More specifically, the back 41 is similar to a gumdrop in shape, but with a longer lower portion and a flat, shorter upper portion. The top pleats 42, 43 are each substantially trapezoidal in shape, having a longer lower portion and a shorter upper portion. The left arm side 44 is essentially square or rectangular in shape, but with a curved upper right hand corner and a cut-out portion in the lower right-hand corner. The right arm side 45 is a mirror-image of the left arm side 44. The left front arm 46 is shaped like a modified, upside-down Christmas stocking, and the right front arm 47 is mirror-image of the left front arm 46. The seat 48, the back ruffle 49, the back facings 55, 56, and the side facings 59A, 59B are each rectangular in shape. The front ruffle is substantially rectangular, but with a projection 50*a* centered in the center of one its longer sides. Like the top pleats 42, 43, the bottom pleats 51, 52 are substantially trapezoidal in shape, but are larger in size. The front facings 53, 54 are L-shaped. It is understood that while specific shapes of the pattern components have been described, it is understood that modifications to the shapes and/or sizes of these pattern components may be made provided the components are still suitable for their intended purpose.

The process for assembling the pattern components of FIG. 4 to manufacture the slipcover 30 of the first embodiment will now be described with reference to FIGS. 5A-5S.

Referring to FIG. 5A, the top pleats 42, 43 are sewn to the back 41. One side of the top pleat 42 is sewn to one side of the back 41 along seams 41*a*, 42*a*, such that a lower corner of the back 41 is sewn to a lower corner of the top pleat 42. Similarly, one side of the top pleat 43 is sewn to the other side of the back 41 along seams 41*b*, 43*a*, such that the other lower corner of the back 41 is sewn to a lower corner of the top pleat 43.

As shown in FIG. 5B, the left arm side 44 and the right arm side 45 are sewn to the top pleat 42 and top pleat 43, respectively. That is, the side of the top pleat 42 opposite the side sewn to the back 41 is sewn to the curved side of the left arm side 44 at the seams 42*b* and 44*a*, such that the bottom corner of the top pleat 42 is sewn to the top corner of the cutout portion of the left arm side 44. Similarly, but in the mirror image, the side of the top pleat 43 opposite the side sewn to the back 41 is sewn to the curved side of the right arm side 45 at seams 43*b* and 45*a*, such that the bottom corner of the top pleat 43 is sewn to the top corner of the cutout portion of the right arm side 45. FIG. 5C shows the combination of the back 41, two top pleats 42, 43, left side arm 44, and right side arm 45.

In FIG. 5D, each of the top pleats 42 and 43 is folded in half. Then the upper side of each of the top pleats 42, 43 is sewn closed at seam 41*c*, and the stitching continues such that the left and right arm sides 42, 43 are sewn to respective sides of the back 41 along the seam 41*c*. The pleats formed by the top pleats 42, 43 are then tucked in such that they are set behind the seam 41*c* behind the intersection between the back 41 and the respective left and right arm sides 44, 45.

Figure 5E:
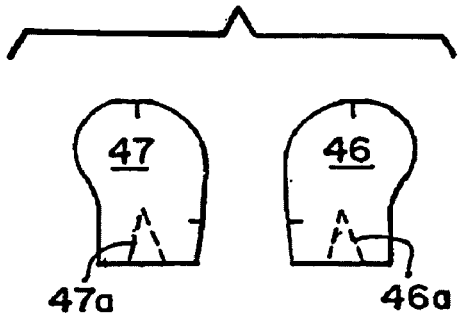
FIGS. 5A-5S are plan views illustrating a sewing sequence for assembling the pattern components of FIG. 4 to manufacture the slipcover of FIGS. 3A-3E.

The left front arm 46 is darted along the dotted line 46*a*, and the right front arm 47 is darted along the dotted line 47*a*, as shown in FIG. 5E. A dart is basically a tapered tuck to adjust a fit of a fabric. The purpose of darting the front arms is to cause the arms of the slipcover 30 to fit snuggly at the front corner of the sofa arms 14*b*.

Figure 5F:
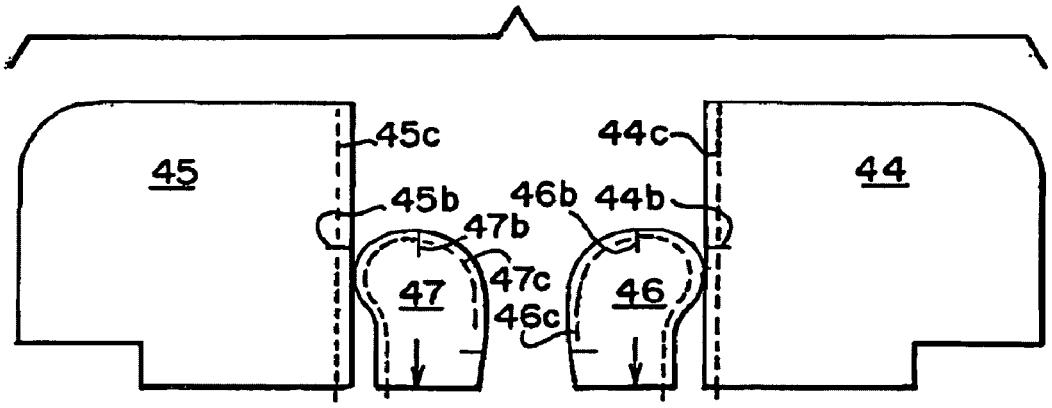

As shown in FIG. 5F, the left and right front arms 46, 47 are sewn to the left and right sides arms 44, 45, respectively. That is, the left front arm 46 is sewn to the left arm side 44 along the seam 44*c*, 46*c* such that longer side of the left arm side 44 is sewn around the side and upper perimeter of the left arm front 46, the notch 44*b* in the middle of the longer side of the left arm side 44 corresponds with the notch 46*b* at the top portion of the left front arm 46, and the bottom edges of the left arm front 46 and the left arm 44 are colinear. Similarly, but in a mirror-image fashion, the right front arm 47 is sewn to the right arm side 45 along the seam 45*c*, 47*c* such that longer side of the right arm side 45 is sewn around the side and upper perimeter of the right arm front 47, the notch 45*b* in the middle of the longer side of the right arm side 45 corresponds with the notch 47*b* at the top portion of the right front arm 47, and the bottom edges of the right arm front 47 and the right arm 45 are colinear.

Figure 5G:
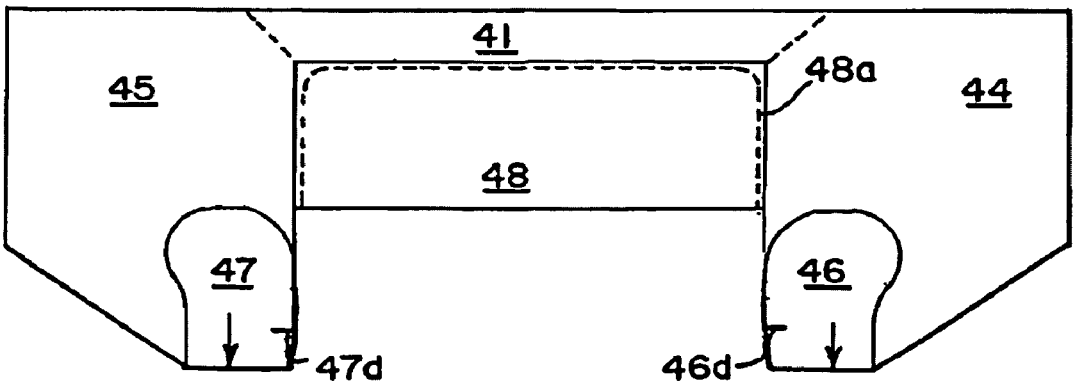

The seat 48 is then sewn along the seam 48*a* to the right arm side 45, back 41, left arm side 44, but not to the right arm front 47 or the left arm front 46, as shown in FIG. 5G. The seat 48 is sewn to the left arm side 44 and the right arm side 45 such that bottom portions of the left and right arm fronts 46, 47 are located at a position lower than the edge of the seat 48. This is accomplished by sewing the seat 48 to the left arm side 44 such that the corresponding lower corner of the seat 48 is located near the notch 46*d* on the inner side of the left arm side 44, and is similarly sewn to the right arm side 45 such that the corresponding lower corner of the seat 48 is located near the notch 47*d* on the inner side of the right arm front 47. This positioning between the seat 48 and the left and right arm sides 44, 45 allows the slipcover 30 to accommodate different arm heights. The exact positioning between the seat 48 and the arm sides 44, 45 is based on the arm dimensions of the sofa being covered.

Figure 5H:
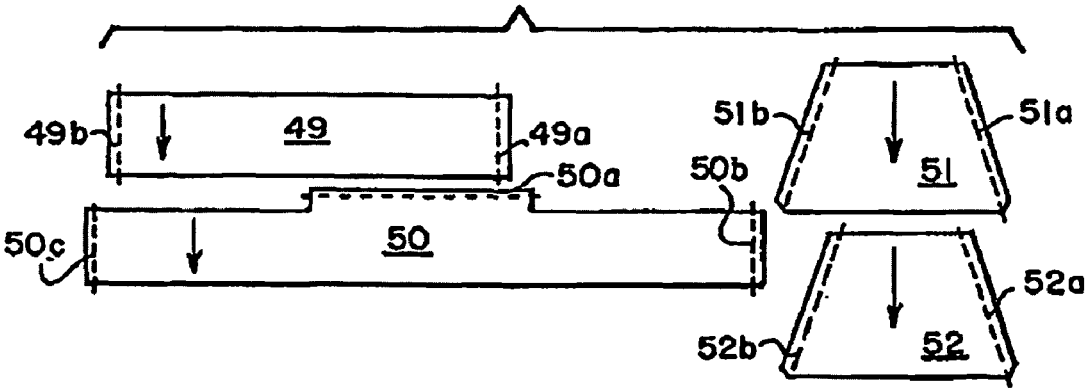
Figure 5I:
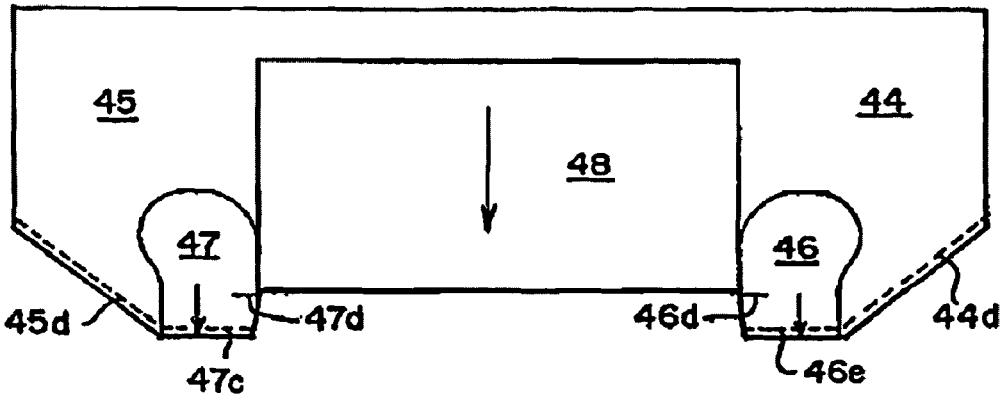

As shown in FIG. 5H, the bottom pleats 51, 52, the back ruffle 49, and the front ruffle 50 are overlock-edged to prevent fraying. Overlock-edging involves covering the edge of the fabric along the dotted lines. The angled sides of the bottom pleat 51 is overlock-edged along seams 51*a*, 51*b*, the angled sides of the bottom pleat 52 is overlock-edged along seams 52*a*, 52*b*, the ends of the back ruffle 49 are overlock-edged along seams 49*a*, 49*b*, and the ends of the front ruffle 50 are overlock-edged along seams 50*b*, 50*c* and extension 50*a*. As shown in FIG. 5I, the bottoms of the left and right arm fronts 46, 47 are also overlock-edged and stitched along seams 46*e* and 47*e*, respectively, and the bottoms of the left and right arm sides 44, 45 are overlock-edged along seams 44*d* and 45*d*, respectively.

Figure 5J:
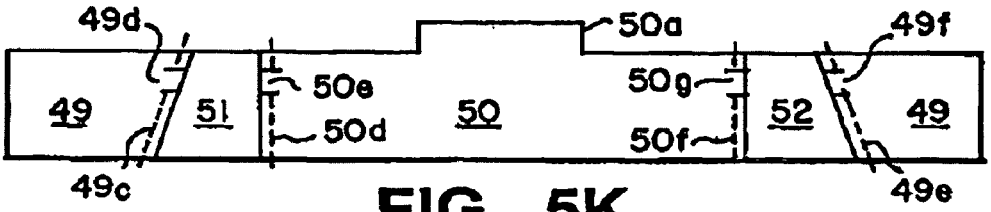

The back ruffle 49, the bottom pleat 51, the front ruffle 50, and the other bottom pleat 52 are sewn together to create a complete circle of fabric, as shown in FIG. 5J, leaving openings between each of the pieces to create mock button holes used to accommodate elastic pieces 57*a* and 57*b* (shown in FIGS. 5P and 5Q) to be applied in a subsequent step. More specifically, one end of the back ruffle 49 is sewn to one angled side of the bottom pleat 51 along seam 49*c* with the exception of the opening between the notches 49*d* (which indicate a mock button hole)le used to accommodate the two pieces of elastic 57*a* and 57*b*. Similarly, the other end of the back ruffle 49 is sewn to one angled side of the bottom pleat 52 along seam 49*e* with the exception of the opening between the notches 49*f* (which indicate a mock button hole) so as to create a mock button hole also used to accommodate the elastic 57*a*, 57*b*. The other angled side of bottom pleat 51 is sewn to one end of the front ruffle 50 along seam 50*d* with the exception of the opening between the notches 50*e* (which indicate a mock button hole), and the other angled side of bottom pleat 52 is sewn to the other end of the front ruffle 50 along seam 50*f* with the exception of the space between the notches 50*g*, which indicate a mock button hole. As shown in the figure, the shorter, upper sides of the bottom pleats 51, 52 are located on the same side of the circle of fabric as the projection 50*a* of the front ruffle 50.

Figure 5K:
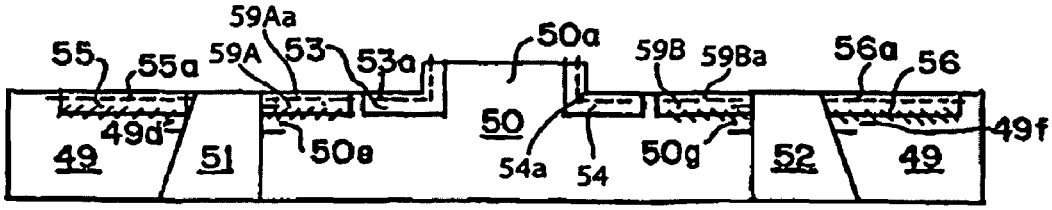
Figure 5L:
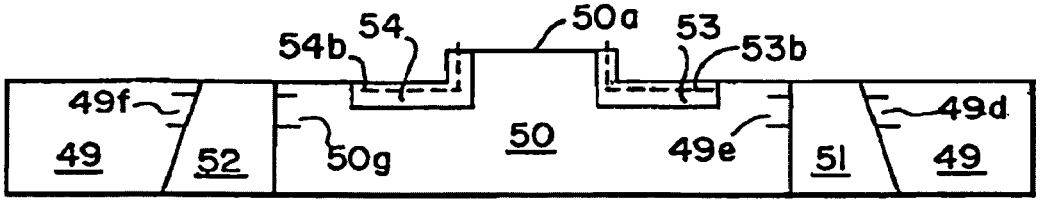

As shown in FIGS. 5K, the two front facings 53, 54 and two side facings 59A, 59B are sewn to the outer side (i.e., face) of the front ruffle 50, and the two back facings 55, 56 are sewn to the inside of the back ruffle 49. The purpose of the facings is to allow the elastic 57*a*, 57*b* to travel therethrough and be covered. In other words, the facings will act as a channel for the elastic 57*a*, 57*b*. The front facing 53 is sewn to the front ruffle 50 along seam 53*a* such that the shorter portion of the L-shaped front facing 53 corresponds with an edge of the projected portion 50*a* of the front ruffle 50, and the edge of the longer portion of the front facing 53 is colinear with the upper side of the respective non-projected portion of the front ruffle 50. Similarly, the front facing 54 is sewn to the front ruffle 50 along seam 54*a* such that the shorter portion of the L-shaped front facing 54 corresponds with the other edge of the projected portion 50*a* of the front ruffle 50, and the edge of the longer portion of the front facing 54 is colinear with the upper side of the respective non-projected portion of the front ruffle 50. The side facing 59A is sewn to the front ruffle 50 at a portion near the bottom pleat 51 along the seam 59A*a* such that an edge of a longer side of each of the side facing 59A is colinear with the upper edge of the front ruffle 50. Similarly, the side facing 59B is sewn to the front ruffle 50 at a portion near the bottom pleat 52 along the seam 59B*a* such that an edge of a longer side of each of the side facing 59B is colinear with the upper edge of the front ruffle 50. The back facing 55 is sewn to the back ruffle 49 at a portion near the bottom pleat 51 along the seam 55*a* such that an edge of a longer side of each of the back facing 55 is colinear with the upper edge of the back ruffle 49. Similarly, the back facing 56 is sewn to the back ruffle 49 at a portion near the bottom pleat 52 along the seam 56*a* such that an edge of a longer side of each of the back facing 56 is colinear with the upper edge of the back ruffle 49. In FIG. 5L the circle of fabric is turned to the inside, and the front facing 53 is backstitched along seam 53*b*, and the front facing 54 is backstitched along seam 54*b*. The purpose of the backstitching is to break the seam so it looks clean.

Figure 5M:
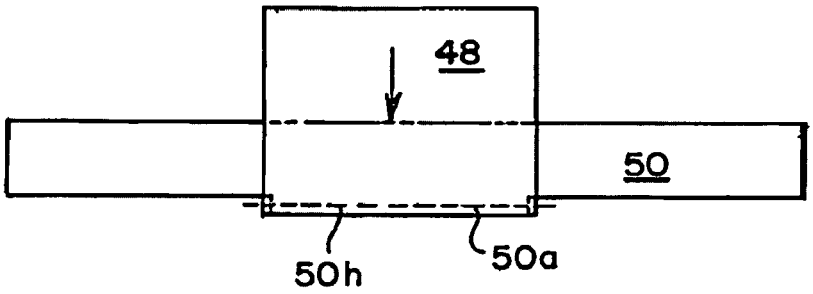
Figure 5N:
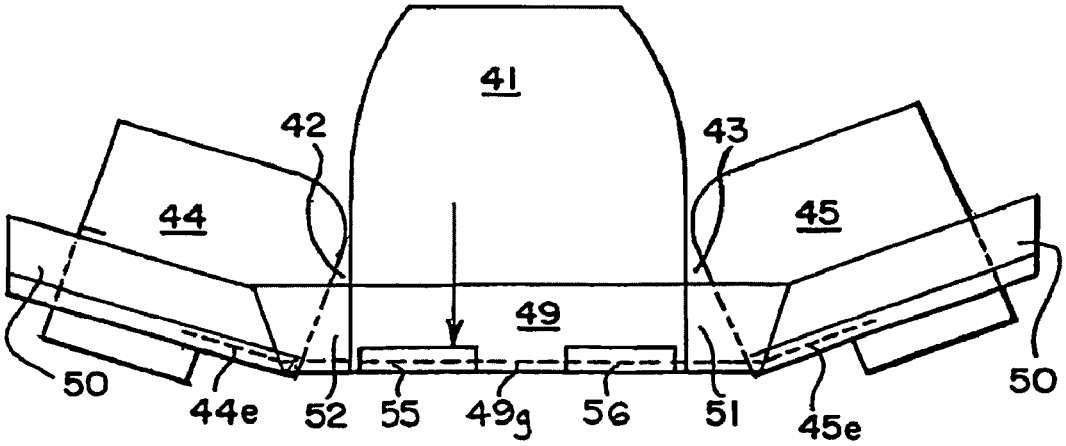
Figure 5O:
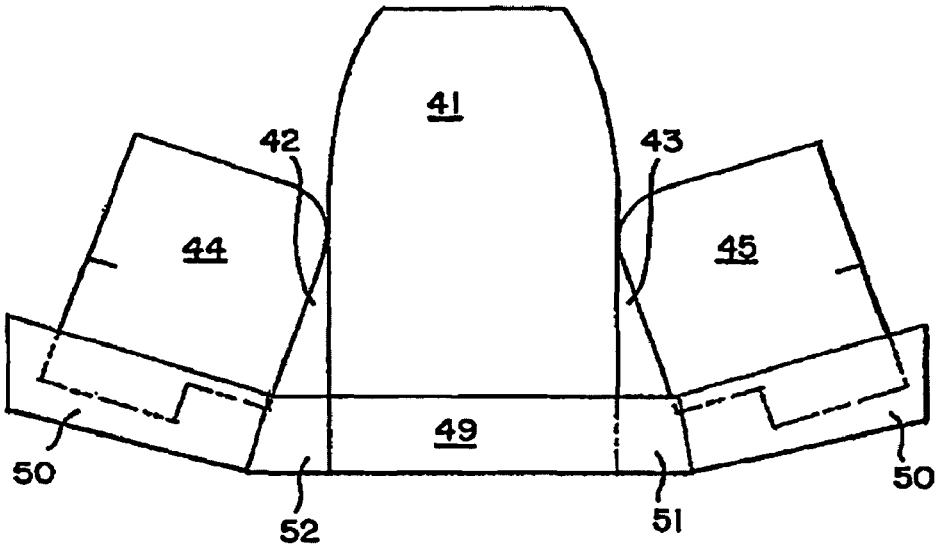

FIG. 5M illustrates the front ruffle 50 being sewn along seam 50*h* to the seat 48 such that one end of the seat 48 and the projected portion 50*a* of the front ruffle 50 are colinear. Then, as shown in FIG. 5N, the back ruffle 49 is sewn to the back 41 along seam 49*g*, and the front ruffle 50 is sewn to the left arm side 44 along seam 44*e* and to the right arm side 45 along seam 45*e*. FIG. 5O shows the combination of the back 41, arm sides 44, 45 back ruffle 49, front ruffle 50, top pleats 42, 43, and bottom pleats 51, 52. The top pleat 42 and the bottom pleat 52 are located between the right arm side 44 and the back 41, and similarly, the top pleat 43 and the bottom pleat 51 are located between the left arm side 45 and the back 41.

Figure 5P:
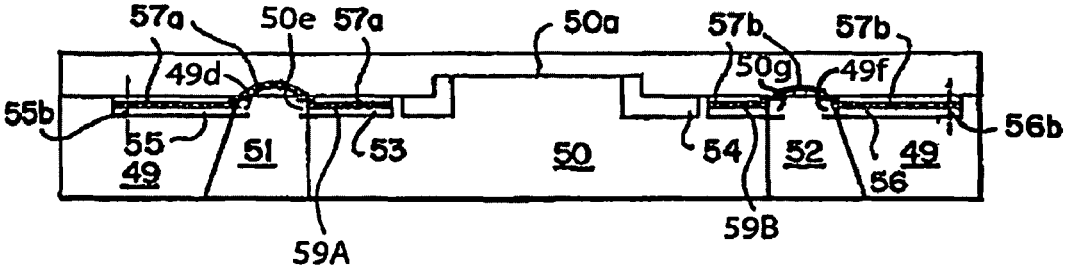

As illustrated in FIG. 5P, two pieces of elastic 57*a*, 57*b* are applied such that they travel behind the front ruffle 50 and in front of the respective bottom pleats 51, 52. That is, a portion of the elastic 57*a* is threaded underneath the back facing 55 (i.e., between the back ruffle 49 and the back facing 55), through the mock button hole 49*d* between the back facing 55 and the bottom pleat 51 to travel in front of the bottom pleat 51, and back through the mock button hole 50*e* between the bottom pleat 51 and the front ruffle 50 to travel underneath the side facing 59A. To secure the elastic portion 57*a* in place, vertical stitches are made near ends of the elastic portion 57*a*, specifically, near the projected portion 50*a* of the front ruffle 50 at point 53*c*, and near the end of the back facing 55 located farthest from the bottom pleat 51 at point 55*b*. Similarly, another portion of elastic 57*b* is threaded underneath the back facing 56, through the mock hole 49*f* between the back facing 56 and the bottom pleat 52 to travel in front of the bottom pleat 52, and back through the mock button hole 50*g* between the bottom pleat 52 and the front ruffle 50 to travel underneath side facing 59B. To secure the elastic portion 57*b* in place, vertical stitches are made near ends of the elastic portion 57*b*, specifically, near the projected portion 50*a* of the front ruffle 50 at point 54*c*, and near the end of the back facing 56 located farthest from the bottom pleat 52 at point 56*b*. The elastic 57*a*, 57*b* is secured to the fabric in a relaxed state.

Figure 5Q:
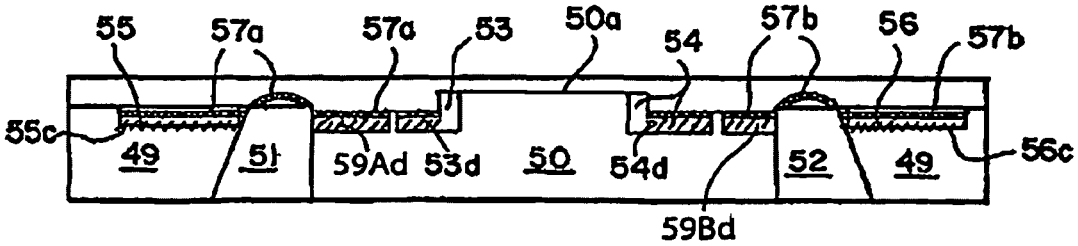

Then, as shown in FIG. 5Q, the bottom edges of the front facings 53, 54, side facings 59A, 59B, and the back facings 55, 56 are blind-stitched so as to enclose the elastic 57*a*, 57*b* within the facings (i.e., between the facings and either the front ruffle 50 or the back ruffle 49). More specifically, the bottom-edge of the front facing 53 is blind-stitched to the front ruffle 50 at 53*d*, the bottom edge of the front facing 54 is blind-stitched to the front ruffle 50 at 54*d*, the side facing 59A is blind-stitched to the front ruffle 50 at 59A*d*, the side facing 59B is blind-stitched to the front ruffle 50 at 59B*d*, the back facing 55 is blind-stitched to the back ruffle 49 at 55*c*, and the back facing 56 is blind-stitched to the back ruffle 49 at 56*c*. Thus the elastic 57*a*, 57*b* is positioned within the facings in much the same way as a string is positioned within a hood of a jacket.

Figure 5R:
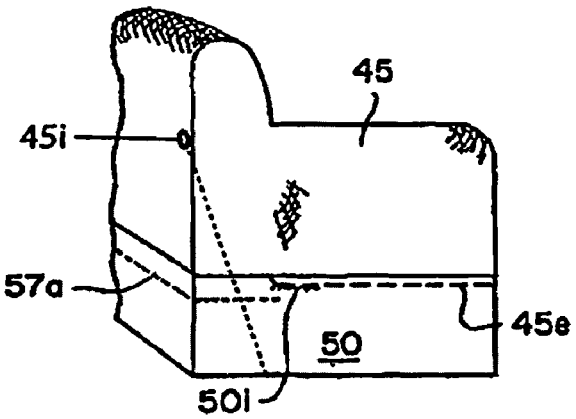
Figure 5S:
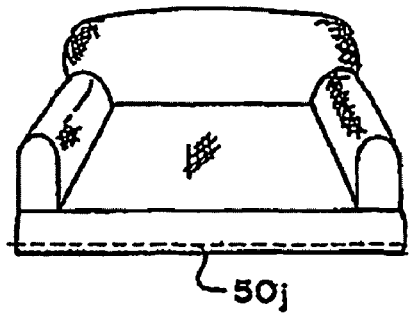

As shown in FIG. 5R, bar-tacks 50*i* are formed at the back end of the seam 45*e* so as to secure the one end of the front ruffle 50 to the right arm side 45. Thus the end of the front ruffle 50 is not secured to the right arm side 45 along at least of portion of the seam 45*e* between the front corner of the sofa and the bar-tacks 50*i*. Bar-tacks are similarly formed on the other side of the sofa to secure the other end of the front ruffle 50 to the left side arm 44. Bar-tacks 45*i* are also placed at the top of the pleats to determine pleat direction during application. Finally, as shown in FIG. 5S, the front ruffle 50 is hemmed at hem line 50*j* to be even with the surface of the floor. The back ruffle 49 is also hemmed to be even with the surface of the floor.

As discussed above, a significant feature of the slipcover of the present invention is the ability of the slipcover to accommodate various sofa arm heights. In this first embodiment this feature is accomplished through the relative positioning of the arm fronts 46, 47 and the seat 48, and the ends of the front ruffle 50 acting as a skirt to cover the ends of the arm sides 44, 45. More specifically, as shown in FIG. 5I, the left arm front 46 and the right arm front 47 are set to be lower than the seat 48. Then the front ruffle 50 is sewn to the seat, as shown in FIG. 5M, however, the ends of the front ruffle 50 are not yet attached to the arm sides 44, 45. Then, as shown in FIG. 5R, the ends of the front ruffle 50 are bar-tacked to the arm sides 44, 45 to thereby cover the excess fabric at the bottoms of the arm sides 44, 45. The amount of excess fabric covered is dependent on the height of the sofa arms 14; the higher the sofa arms 14, the less excess fabric covered. The slipcover therefore accommodates varies arm heights, yet still provides a good fit.

A slipcover according to a second embodiment of the present invention is shown generally at 60 in FIGS. 6A-6E, 7, and 8A-8S, with FIGS. 6A-6E illustrating the slipcover being applied to the sofa 10 depicted in FIGS. 1 and 2, FIG. 7 illustrating pattern components of the slipcover 60 of FIGS. 6A-6E, and FIGS. 8A-8R illustrating a sewing sequence for assembling the pattern components of FIG. 7 to manufacture the slipcover 60 of FIGS. 6A-6E.

The slipcover 60 of the second embodiment is different from the slipcover 30 of the first embodiment in that its design is geared toward a more simple and relaxed look. In particular, the slipcover 60 fits over the seat cushion 18 rather than there being a separate seat cushion cover. Also, the arms of the slipcover 60 have a more simple, round shaped, and are not darted. Therefore, while the slipcover 60 of the second embodiment is like the slipcover 30 of the first embodiment in that it can accommodate various sofa sizes through pleated areas having elastic running therethrough in the back corners and having a split arm with modified wrap skirt function, the design of its pattern components is somewhat different in order to create the more casually-looking style.

Figure 6A:
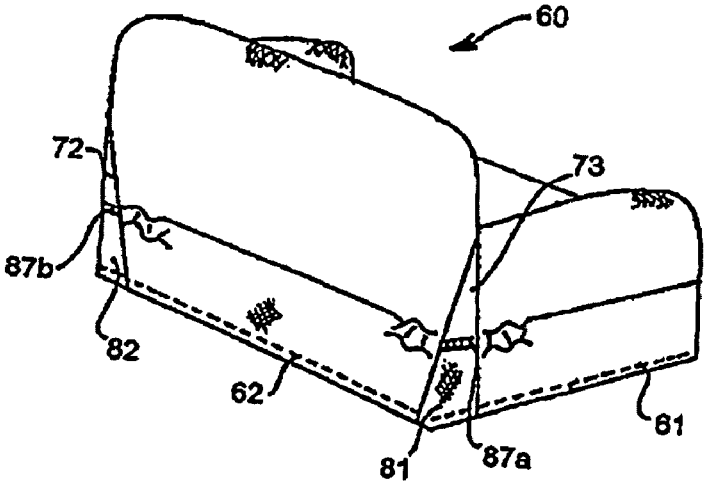
FIGS. 6A-6E are perspective views of a slipcover according to a second embodiment of the present invention being applied to the seating-type furniture illustrated in FIG. 1.
Figure 6B:
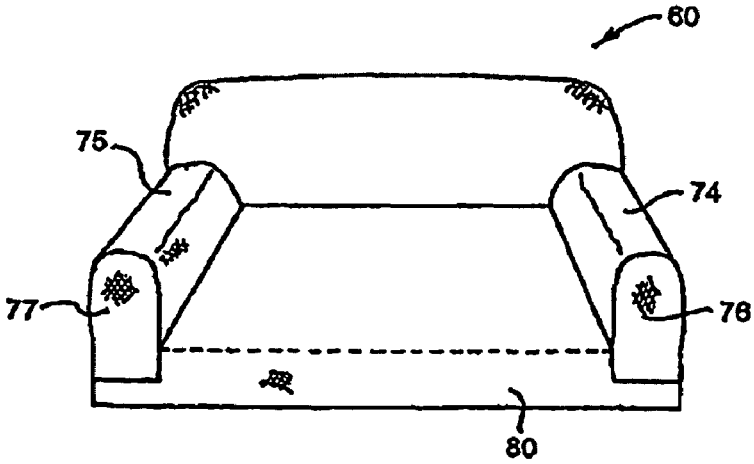
Figure 6C:
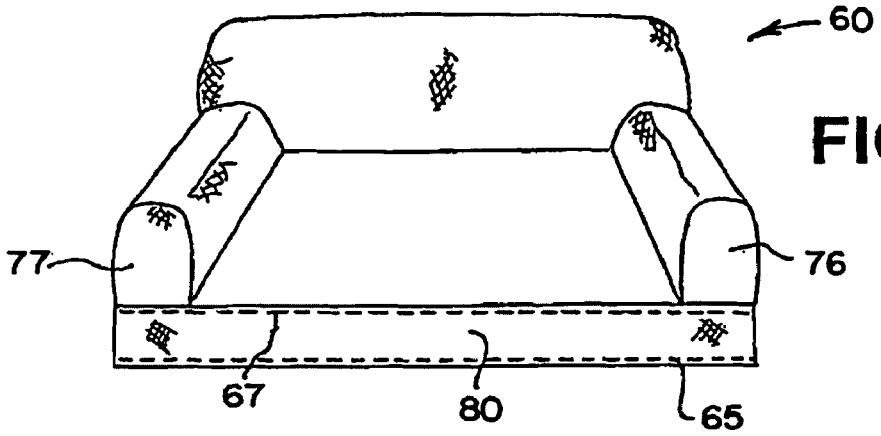
Figure 6D:
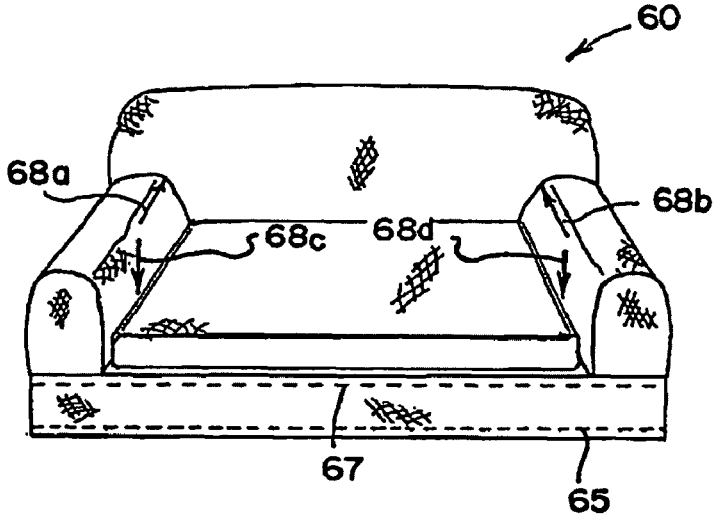

FIGS. 6A-6E illustrate the slipcover 60 being applied to the sofa 10 illustrated in FIGS. 1 and 2. The slipcover 60 of this embodiment is applied to the sofa 10 in much the same way the slipcover 30 of the first embodiment is applied, with an exception that the seat cushion is covered by the slipcover 60, as shown in FIG. 6D, rather than having a separate seat cushion covering, as shown in FIG. 3D. Although much of the application between the first and second embodiments is the same, a full description of the application of the slipcover 60 according to the second embodiment is nevertheless provided because the reference numerals are different.

As shown in FIG. 6A, the slipcover 60 is first placed over the back of the sofa 10, and back pleats 72, 73, 81, 82 open to accommodate the sofa circumference. The back and sides of the slipcover 60 are then placed evenly with the floor. Hems are represented by the dotted lines 61, 62, which run parallel with the surface of the floor.

As shown in FIG. 6B, the slipcover 60 is then pulled over the front of the sofa. The arms 74, 75, 76, 77 of the cover 60 are set onto the sofa arms 14 and pulled over the arm 14. As shown in FIG. 6C, the front ruffle 80 is then adjusted over the base of the sofa arms 14, and the front, bottom edge of the slipcover 30 is placed to be even with the surface of the floor. Dotted lines 65 and 67, which each run parallel with the surface of the floor, represent a hem line and topstitching, respectively.

FIG. 6D shows a departure from the first embodiment in that the single seat cushion, which is set onto the base 12 of the sofa 10, is covered by the slipcover 60 rather than there being a separate seat cushion cover. Alternatively, there could be multiple seat cushions in place of the single seat cushion. The slipcover 60 is then tucked into intersections between the sofa back 16 and the arms 14, as indicated by arrows 68*a* and 68*b*, and is tucked into intersection between the sofa arms 14 and the seat cushion 18, as indicated by arrows 68*c* and 68*d*.

Figure 6E:
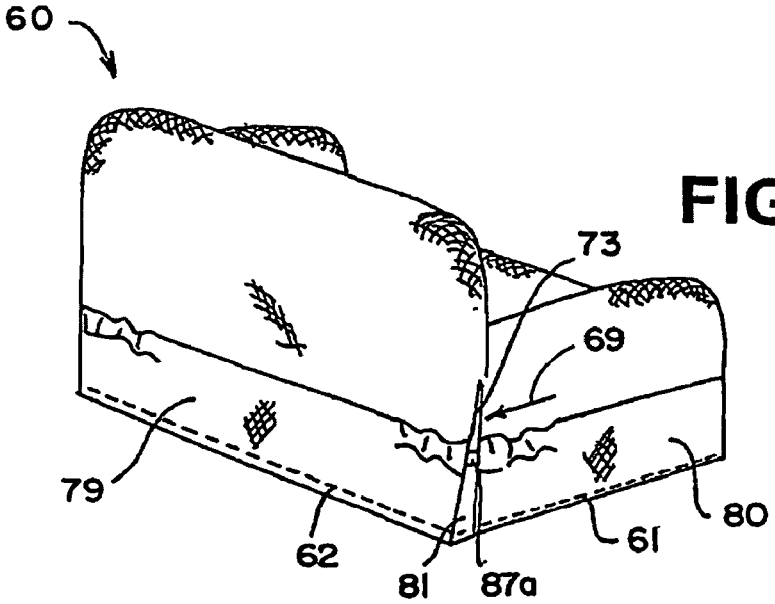

Finally, as shown in FIG. 6E, the pleats are closed at the sofa base by pulling on ends of the front ruffle 80 and back ruffle 79 bordering the pleated area, as indicated by arrow 69. The slipcover easily relaxes to fit the smaller base through the elastic 87*a* (and 87*b*, which is not shown) sewn into the pleated seams and traveling across the pleated areas.

FIG. 7 is a plan view of the pattern components of the slipcover 60 of the second embodiment of the present invention, where the arrows denote grain lines of the fabric. FIGS. 8A-8R are plan views illustrating a sewing sequence for assembling the pattern components of FIG. 7 to manufacture the slipcover of FIGS. 6A-6E.

Referring to FIG. 7, the pattern components include a back 71, two top pleats 72, 73, left arm side 74, right arm side 75, left arm front 76, right arm front 77, seat 78, back ruffle 79, front ruffle 80, two bottom pleats 81, 82, two side facings 83, 84, and two back facings 85, 86. Many of the shapes of the pattern components of the second embodiment are the same as those of the first embodiment, that is, the back 71, top pleats 72, 73, left arm side 74, right arm side 75, back ruffle, bottom pleats 81, 82, and back facings 85, 86, and thus a detailed description of these components will be omitted here for the sake of brevity.

The left and right front arms 76, 77 of the second embodiment are different from the left and right front arms 46, 47 of the first embodiment in that these front arms 76, 77 have a more simple round shape, as opposed to the upside-down Christmas stocking shape of the first embodiment. This more simple shape is consistent with the more relaxed look of the slipcover 60 of the second embodiment.

The seat 78 of this embodiment has two lower projections 78*c*, 78*d*, as opposed to the rectangular shape of the seat 48 in the first embodiment.

The front ruffle 80 of the second embodiment is different from that of the first embodiment in that rather than being substantially rectangular except for a projection centered in the center of one its longer sides, it is simply rectangular in shape. And the side facings 83, 84 are substantially the same as the back facings 85, 86, that is, are rectangular in shape.

As with the first embodiment, it is understood that while specific shapes of the pattern components have been described, it is understood that modifications to the shapes and/or sizes of these pattern components may be made provided the components are still suitable for their intended purpose.

The process for assembling the pattern components of FIG. 7 to manufacture the slipcover 60 of the second embodiment will now be described with reference to FIGS. 8A-8R.

Referring to FIG. 8A, which is similar to FIG. 5A, the top pleats 72, 73 are sewn to the back 71. One side of the top pleat 72 is sewn to one side of the back 71 along seams 71*a*, 72*a*, such that a lower corner of the back 71 is sewn to a lower corner of the top pleat 72. Similarly, one side of the top pleat 73 is sewn to the other side of the back 71 along seams 71*b*, 73*a*, such that the other lower corner of the back 71 is sewn to a lower corner of the top pleat 73.

As shown in FIG. 8B, which is similar to FIG. 5B, the left arm side 74 and the right arm side 75 are sewn to the top pleat 72 and top pleat 73, respectively. That is, the side of the top pleat 72 opposite the side sewn to the back 71 is sewn to the curved side of the left arm side 74 at the seams 72*b* and 74*a*, such that the bottom corner of the top pleat 72 is sewn to the top corner of the cutout portion of the left arm side 74. Similarly, but in the mirror image, the side of the top pleat 73 opposite the side sewn to the back 71 is sewn to the curved side of the right arm side 75 at seams 73*b* and 75*a*, such that the bottom corner of the top pleat 73 is sewn to the top corner of the cutout portion of the right arm side 75. FIG. 8C shows the combination of the back 71, two top pleats 72, 73, left side arm 74, and right side arm 75.

In FIG. 8D, which is similar to FIG. 5D, each of the top pleats 72 and 73 is folded in half. Then the upper side of each of the top pleats 72, 73 is sewn closed at seam 71*c*, and the stitching continues such that the left and right arm sides 72, 73 are sewn to respective sides of the back 71 along the seam 71*c*. The pleats formed by the top pleats 72, 73 are then tucked in such that they are set behind the seam 71*c* behind the intersection between the back 71 and the respective left and right arm sides 74, 75.

Figure 8E:
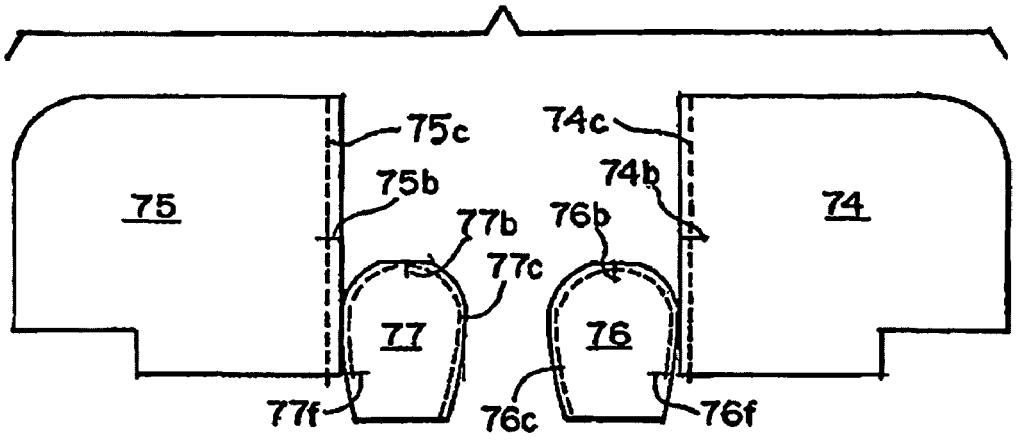
FIGS. 8A-8R are plan views illustrating a sewing sequence for assembling the pattern components of FIG. 7 to manufacture the slipcover of FIGS. 6A-6E.

As shown in FIG. 8E, the left and right front arms 76, 77 are sewn to the left and right sides arms 74, 75, respectively. That is, the left front arm 76 is sewn to the left arm side 74 along the seam 74*c*, 76*c* such that the side of the left arm side 74 is sewn around the one side, upper perimeter and other side of the left arm front 76. The notch 74*b* in the middle of the longer side of the left arm side 74 corresponds with the notch 76*b* at the top portion of the left front arm 76, and the notch 76*f* in the middle of the one side of the left arm front 76 corresponds with the lower corner of the left arm side 74. Similarly, but in a mirror-image fashion, the right front arm 77 is sewn to the right arm side 75 along the seam 75*c*, 77*c* such that the side of the right arm side 75 is sewn around the one side, upper perimeter and other side of the right arm front 77. The notch 75*b* in the middle of the longer side of the right arm side 75 corresponds with the notch 77*b* at the top portion of the right front arm 77, and the notch 77*f* in the middle of the one side of the right arm front 77 corresponds with the lower corner of the right arm side 75.

Figure 8F:
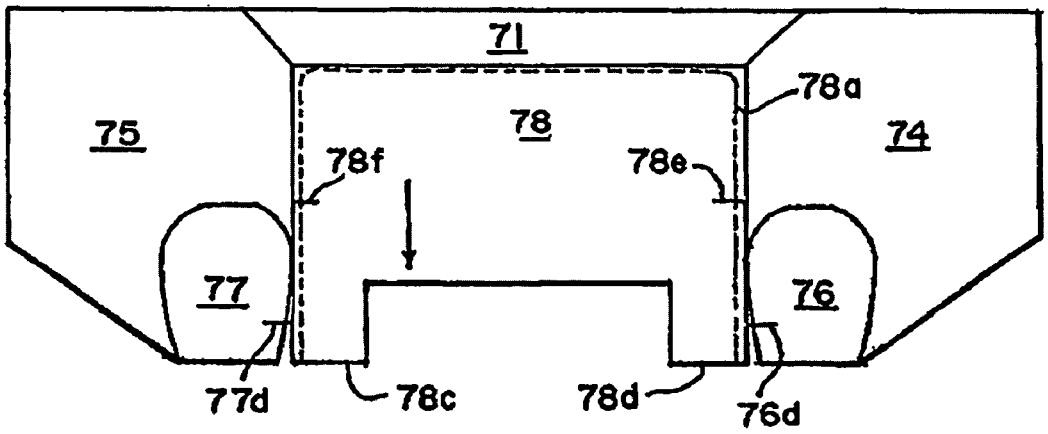

The seat 78 is then sewn along the seam 78*a* to the right arm front 77, right arm side 75, back 71, left arm side 74, and left arm front 76, as shown in FIG. 8F. The seat 78 is sewn to the left arm front 76 and the right arm front 77 such that bottom portions of the left and right arm fronts 76, 77 and of the bottom portions of the projections 78*c*, 78*d* are colinear. Also, a cinching element is secured at least between each of the two sets of double notches 78*e*, 78*f* on the respective sides of the seat 78. The cinching element is an elastic band which is secured while the band is in an extended or stretched condition. In this way, when the band is allowed to relax and return to an unstretched condition, it cinches at least a portion of the periphery of the side and back edge of the seat 78 in a manner similar to a shower cap (except that unlike the shower cap, the elastic band provided in the slipcover does not extend around the entire periphery of the seat 78). Thus, the seat 78 is a piece of material with at least a portion of its periphery having a retracted dimension, thereby forming a three-dimensional pouch, which in a relaxed, unstretched state cinches at least a portion of each of the side and back edges of a seat cushion 18 of a piece of seating furniture, while leaving the front edge of the seat cushion uncinched. While the preferred cinching element is an elastic band, alternative cinching elements, such as a drawstring, may be used to effectively reduce at least a portion of the side edges of the seat 78, in order to secure the seat 78 around at least a portion of the side and back edge of the seat cushion 18.

Figure 8G:
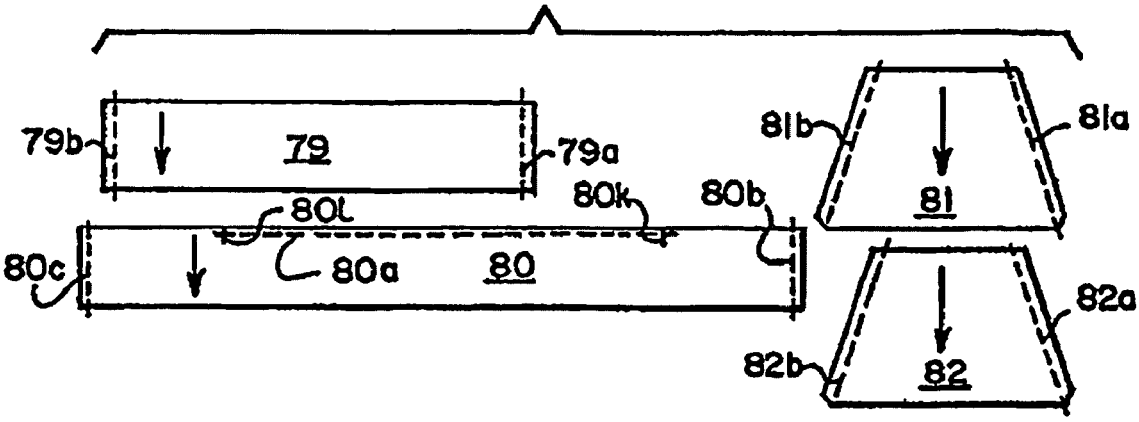

As shown in FIG. 8G, the bottom pleats 81, 82, the back ruffle 79, and the front ruffle 80 are overlock-edged to prevent fraying. The angled sides of the bottom pleat 81 are overlock-edged along seams 81*a*, 81*b*, the angled sides of the bottom pleat 82 are overlock-edged along seams 82*a*, 82*b*, the ends of the back ruffle 79 are overlock-edged along seams 79*a*, 79*b*, and the ends of the front ruffle 80 are overlock-edged along seams 80*b*, 80*c*, and the top of the front ruffle 80 is overlock-edged along seam 80*a* between notches 80*k* and 80*l*.

Figure 8H:
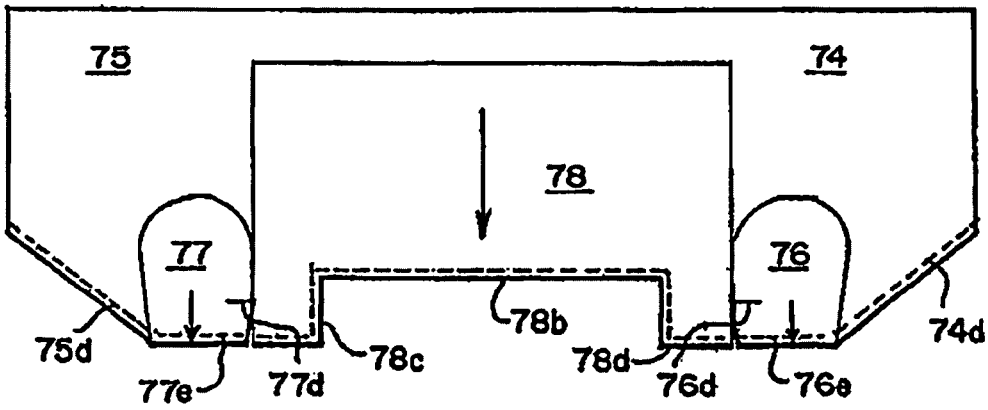

As shown in FIG. 8H, the bottoms of the left and right arm fronts 76, 77 are also clean-finished and stitched along seams 76*e* and 77*e*, respectively. The bottoms of the left and right arm sides 74, 75 are clean-finished along seams 74*d* and 75*d*, respectively. Seams 76*e* and 74*d* together form one continuous seam. Also, the bottom of the seat 78 is clean-finished along seam 78*b*, which also runs along the bottom and inner periphery of the projections 78*c*, 78*d*.

Figure 8I:
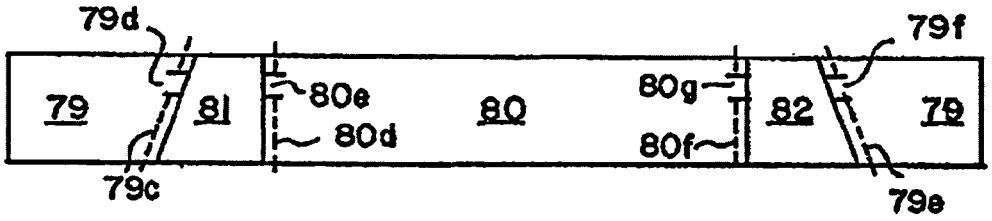

The back ruffle 79, the bottom pleat 81, the front ruffle 80, and the other bottom pleat 82 are sewn together to create a complete circle of fabric, as shown in FIG. 8I, leaving openings between each of the pieces to create mock button holes used to accommodate elastic pieces 87*a* and 87*b* (shown in FIGS. 8M and 8N) to be applied in a subsequent step. More specifically, one end of the back ruffle 79 is sewn to one angled side of the bottom pleat 81 along seam 79*c* with the exception of the opening between the notches 79*d* (which indicate a mock button hole) so as to create a mock button hole used to accommodate the two pieces of elastic 87*a* and 87*b*. Similarly, the other end of the back ruffle 79 is sewn to one angled side of the bottom pleat 82 along seam 79*e* with the exception of the opening between the notches 79*f* (which indicate a mock button hole) so as to create a mock button hole also used to accommodate the elastic 87*a*, 87*b*. The other angled side of bottom pleat 81 is sewn to one end of the front ruffle 80 along seam 80*d* with the exception of the opening between the notches 80*e* (which indicate a mock button hole), and the other angled side of bottom pleat 82 is sewn to the other end of the front ruffle 80 along seam 80*f* with the exception of the space between the notches 80*g*, which indicate a mock button hole.

Figure 8J:
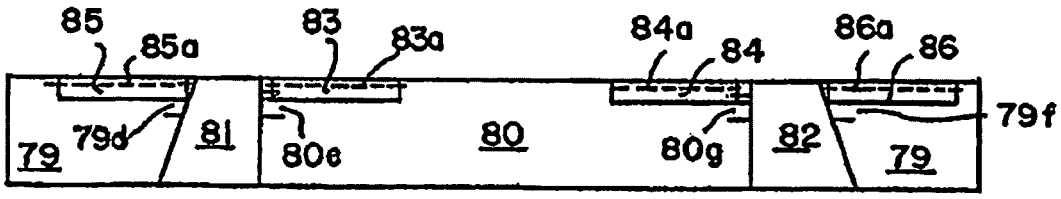

As shown in FIG. 8J, the two side facings 83, 84 are sewn to the outer side (i.e., face) of the front ruffle 80, and the two back facings 85, 86 are sewn to the outer side of the back ruffle 79. As in the first embodiment, the purpose of the facings is to allow the elastic 87*a*, 87*b* to travel therethrough and be covered. In other words, the facings will act as a channel for the elastic 87*a*, 87*b*. The side facing 83 is sewn to the front ruffle 80 at a portion near the bottom pleat 81 along seam 83*a* such that the top edge of the side facing 83 is colinear with the upper side of the front ruffle 80. Similarly, the side facing 84 is sewn to the front ruffle 80 at a portion near the bottom pleat 82 along seam 84*a* such that the top edge of the side facing 84 is colinear with the upper side of the front ruffle 80. The back facing 85 is sewn to the back ruffle 79 at a portion near the bottom pleat 81 along the seam 85*a* such that the top edge of the back facing 85 is colinear with the upper edge of the back ruffle 79. Similarly, the back facing 86 is sewn to the back ruffle 79 at a portion near the bottom pleat 82 along the seam 86*a* such that the top edge of the back facing 86 is colinear with the upper edge of the back ruffle 79.

Figure 8K:
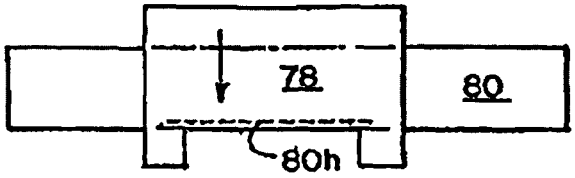
Figure 8L:
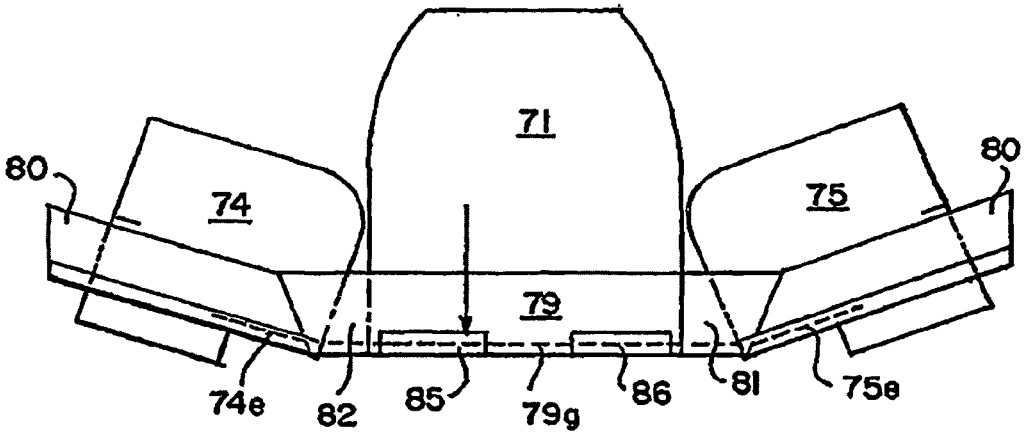

FIG. 8K illustrates the front ruffle 80 being sewn along seam 80*h* to the seat 78 such that one end of the front ruffle 80 and the base of the non-projected portion of the seat 78 are colinear. Then, as shown in FIG. 8L, the back ruffle 79 is sewn to the back 71 along seam 79*g*, and the front ruffle 80 is sewn to the left arm side 74 along seam 74*e* and to the right arm side 75 along seam 75*e*. Seams 79*g*, 74*e*, and 75*e* together form one continuous seam. The top pleat 72 (not shown) and the bottom pleat 82 are located between the left arm side 74 and the back 71, and similarly, the top pleat 73 (not shown) and the bottom pleat 81 are located between the right arm side 75 and the back 71.

Figure 8M:
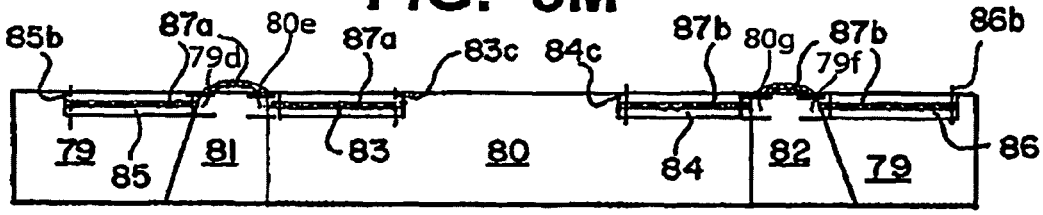

As illustrated in FIG. 8M, two pieces of elastic 87*a*, 87*b* are applied such that they travel behind the front ruffle 80 and in front of the respective bottom pleats 81, 82. That is, a portion of the elastic 87*a* is threaded underneath the back facing 85 (i.e., between the back ruffle 79 and the back facing 85), through the mock button hole 79*d* between the back facing 85 and the bottom pleat 81 to travel in front of the bottom pleat 81, and back through the mock button hole 80*e* between the bottom pleat 81 and the front ruffle 80 to travel underneath the side facing 83. To secure the elastic portion 87*a* in place, vertical stitches are made near an inner end of the elastic portion 87*a* at point 83*c*, and near the end of the back facing 85 located farthest from the bottom pleat 81 at point 85*b*. Similarly, another portion of elastic 87*b* is threaded underneath the back facing 86, through the mock button hole 79*f* between the back facing 86 and the bottom pleat 82 to travel in front of the bottom pleat 82, and back through the mock button hole 80*g* between the bottom pleat 82 and the front ruffle 80 to travel underneath side facing 84. To secure the elastic portion 87*b* in place, vertical stitches are made near end an inner end of the elastic portion 87*b* at point 84*c*, and near the end of the back facing 86 located farthest from the bottom pleat 82 at point 86*b*. The elastic 87*a*, 87*b* is secured to the fabric in a relaxed state.

Figure 8N:
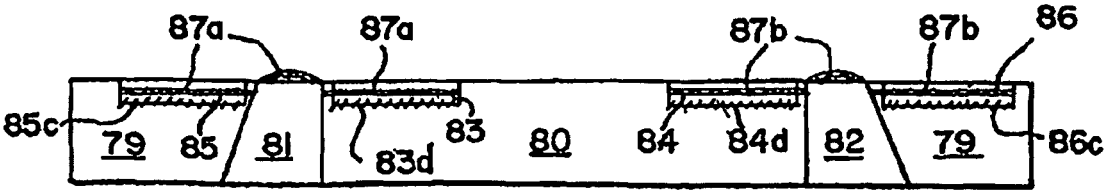

Then, as shown in FIG. 8N, the bottom edges of the side facings 83, 84 and the back facings 85, 86 are blind-stitched so as to enclose the elastic 87 within the facings (i.e., between the facings and either the front ruffle 80 or the back ruffle 79). More specifically, the bottom edge of the side facing 83 is blind-stitched to the front ruffle 80 at 83*d*, the bottom edge of the side facing 84 is blind-stitched to the front ruffle 80 at 84*d*, the back facing 85 is blind-stitched to the back ruffle 79 at 85*c*, and the back facing 86 is blind-stitched to the back ruffle 79 at 86*c*. Thus the elastic 87*a*, 87*b* is positioned within the facings in much the same way as a string is positioned within a hood of a jacket.

FIGS. 8O and 8P show the front ruffle 80 hemmed and top-stitched. More specifically, the front ruffle 80 is hemmed along hem lines 80*m* and 80*n*, which run parallel with the respective front ruffle top edge portion that is not sewn to the seat 78, as shown in FIG. 8O. The front ruffle 80 is back-stitched along dotted line 80*o*, which runs parallel with the front ruffle top edge portion that is sewn to the seat 78, as shown in FIG. 8P.

As shown in FIG. 8Q, the front ruffle 80 is bar-tacked at four points. Bar-tacks 80*j* are formed at the back end of the seam 75*e* so as to secure the one end of the front ruffle 80 to the right arm side 75. Thus the end of the front ruffle 80 is not secured to the right arm side 75 along at least of portion of the seam 75*e* between the front corner of the sofa and the bar-tacks 80*j*. Bar-tacks are similarly formed on the other side of the sofa to secure the other end of the front ruffle 80 to the left side arm 74. Bar-tacks 80*p* and 80*q* are also formed at the respective ends of the top-stitch line 80*o* so as to secure the front ruffle 80 to the seat 78. Bar-tacks 80*i* are also placed at the top of the pleats to determine pleat direction during application.

Finally, as shown in FIG. 8R, the front ruffle 80 is hemmed at hem line 80*j* to be even with the surface of the floor. The back ruffle 79 is also hemmed to be even with the surface of the floor.

As discussed above, a significant feature of the slipcover of the present invention is the ability of the slipcover to accommodate various sofa arm heights. In this second embodiment this feature is accomplished through the relative positioning of the arm fronts 76, 77 and the seat 78, and the ends of the front ruffle 80 acting as a skirt to cover the ends of the arm sides 74, 75. More specifically, as shown in FIG. 8H, the bottom edges of the left arm front 76 and the right arm front 77 are set to be colinear with the bottom edge of the seat 78. Then the front ruffle 80 is sewn to the seat, as shown in FIG. 8K, however, the ends of the front ruffle 80 are not yet attached to the arm sides 74, 75. Then, as shown in FIG. 8Q, the ends of the front ruffle 80 are bar-tacked to the arm sides 74, 75 to thereby cover the excess fabric at the bottoms of the arm sides 74, 75. The amount of excess fabric covered is dependent on the height of the sofa arms 14; the higher the sofa arms 14, the less excess fabric covered. The slipcover therefore accommodates varies arm heights, yet still provides a good fit.

The slipcover may be made from any of a variety of materials or fabrics, such as typical upholstery-type fabrics or plastic materials. The elastic may be secured to the slipcover covering using any conventional securement method, such as sewing or adhesive bonding. Where the slipcover is formed from a thermoplastic material, the elastic may be ultrasonically welded to the slipcover portions, using conventional techniques.

Also, while the slipcover has been described as being applicable to a sofa, it is understood that the slipcover may be applied to any seating-type furniture having a base, a back, and generally a seat cushion, though a seat cushion is not a requirement.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A slipcover for a piece of furniture including a base, a back, first and second arms, and a seat portion, the slipcover comprising:

a back portion for covering the back of the furniture;

first and second arm portions for covering the first and second arms; and back pleats located at respective back corners of the slipcover and having pleated seams and elastic, each back pleat joining the back portion to one of the first and second arm portions by at least in part extending between and being attached to a side of the back portion and a side of the respective arm portion that the respective back pleat joins to the back portion, the elastic running through the pleated seams and traveling across an outer surface of the back pleats to allow the slipcover to expand over a largest perimeter of the furniture and then relax to fit the base of the furniture as the slipcover is placed on the furniture, wherein the back pleats each comprise a top pleat and a bottom pleat, and the bottom pleat is larger than the top pleat.

2. The slipcover of claim 1, further comprising a wrap skirt for covering respective bottom portions of the first and second arm portions, and wherein the first and second arm portions, respectively, include first and second arm fronts for covering respective top front portions of the first and second arms.

3. The slipcover of claim 2, wherein the first and second arm fronts are darted.

4. The slipcover of claim 3, wherein the first and second arm portions further include first and second arm sides attached to the respective first and second arm fronts, wherein each of the first and second arm fronts has a shape of an upside-down Christmas stocking, and the right arm front is a mirror-image of the left arm front.

5. The slipcover of claim 4, further comprising a seat, wherein bottom edges of the first and second arm fronts are positioned to be lower than a bottom edge of the seat, wherein the wrap skirt further comprises a front ruffle for covering the bottom portions of the first and second arm portions along with the dart lines of the first and second arm fronts, the wrap skirt having a middle portion secured to the seat and having ends tacked to the first and second arm sides, and thereby covering any excess fabric at the bottoms of the first and second arm sides.

6. The slipcover of claim 1, further comprising a seat which fits over a seat cushion of the furniture.

7. The slipcover of claim 1, further comprising a separate seat cushion cover for a seat cushion of the furniture.

8. The slipcover of claim 1, wherein the first and second arm portions, respectively, include first and second arm fronts for covering respective top front portions of the first and second arms, wherein the first and second arm portions further include first and second arm sides attached to the respective first and second arm fronts, and wherein each of the first and second arm fronts has a dome shape and is undarted.

9. The slipcover of claim 8, further comprising:

a seat, wherein bottom edges of the first and second arm fronts are positioned to be colinear with a bottom edge of the seat; and a front ruffle for covering the bottom portions of the first and second arms, the front ruffle having a middle portion secured to the seat and having ends tacked to the first and second arm sides, and thereby cover any excess fabric at the bottoms of the first and second arm sides.

10. The slipcover of claim 9, wherein the amount of excess fabric covered depends on the height of the first and second arms.

11. A slipcover for a piece of furniture including a base, a back, first and second arms, and a seat portion, the slipcover comprising:

a back portion for covering the back of the furniture;

first and second arm portions for covering the first and second arms; and back pleats located at respective back corners of the slipcover and having pleated seams and elastic, each back pleat joining the back portion to one of the first and second arm portions, the elastic running through the pleated seams and traveling across an outer surface of the back pleats to allow the slipcover to expand over a largest perimeter of the furniture and then relax to fit the base of the furniture as the slipcover is placed on the furniture, wherein the back pleats each comprise at least one pleat, and the at least one pleat has a substantially trapezoidal shape.

12. The slipcover of claim 11, further comprising a wrap skirt for covering respective bottom portions of the first and second arm portions, and wherein the first and second arm portions, respectively, include first and second arm fronts for covering respective top front portions of the first and second arms.

13. The slipcover of claim 12, wherein the first and second arm fronts are darted.

14. The slipcover of claim 13, wherein the first and second arm portions further include first and second arm sides attached to the respective first and second arm fronts, wherein each of the first and second arm fronts has a shape of an upside-down Christmas stocking, and the right arm front is a mirror-image of the left arm front.

15. The slipcover of claim 14, wherein the slipcover further comprises a seat, wherein bottom edges of the first and second arm fronts are positioned to be lower than a bottom edge of the seat, wherein the wrap skirt further comprises a front ruffle for covering the bottom portions of the first and second arm portions along with the dart lines of the first and second arm fronts, the wrap skirt having a middle portion secured to the seat and having ends tacked to the first and second arm sides, and thereby covering any excess fabric at the bottoms of the first and second arm sides.

16. The slipcover of claim 11, wherein the slipcover further comprises a seat which fits over a seat cushion of the furniture.

17. The slipcover of claim 11, wherein the slipcover further comprises a separate seat cushion cover for a seat cushion of the furniture.

18. The slipcover of claim 11, wherein the first and second arm portions, respectively, include first and second arm fronts for covering respective top front portions of the first and second arms, wherein the first and second arm portions further include first and second arm sides attached to the respective first and second arm fronts, and wherein each of the first and second arm fronts has a dome shape and is undarted.

19. The slipcover of claim 18, wherein the slipcover further comprises:

a seat, wherein bottom edges of the first and second arm fronts are positioned to be colinear with a bottom edge of the seat, wherein the wrap skirt further comprises a front ruffle for covering the bottom portions of the first and second arm portions, the wrap skirt having a middle portion secured to the seat and having ends tacked to the first and second arm sides, and thereby covering any excess fabric at the bottoms of the first and second arm sides.

20. The slipcover of claim 19, wherein the amount of excess fabric covered depends on the height of the first and second arms.

21. The slipcover of claim 11, wherein each back pleat joins the back portion to one of the first and second arm portions by at least in part extending between and being attached to a side of the back portion and a side of the respective arm portion that the respective back pleat joins to the back portion.

* * * * *